US009725199B2

(12) United States Patent
Actis

(10) Patent No.: US 9,725,199 B2
(45) Date of Patent: Aug. 8, 2017

(54) BAG RETRIEVAL ASSEMBLY AND BAG FOR PRESSED BALES

(75) Inventor: Bradley P. Actis, Clovis, CA (US)

(73) Assignee: H.W.J. DESIGNS FOR AGRIBUSINESS, INC., Clovis, CA (US)

( * ) Notice: Subject to any disclaimer, the term of this patent is extended or adjusted under 35 U.S.C. 154(b) by 1772 days.

(21) Appl. No.: 12/626,558

(22) Filed: Nov. 25, 2009

(65) Prior Publication Data

US 2010/0126118 A1 May 27, 2010

Related U.S. Application Data

(60) Provisional application No. 61/118,175, filed on Nov. 26, 2008, provisional application No. 61/033,376, filed on Mar. 3, 2008.

(51) Int. Cl.

| | |
|---|---|
| ***B65B 43/26*** | (2006.01) |
| ***B65B 43/46*** | (2006.01) |
| ***B65B 57/00*** | (2006.01) |
| ***B65D 33/00*** | (2006.01) |
| ***B65B 65/00*** | (2006.01) |
| ***B65B 63/02*** | (2006.01) |

(52) U.S. Cl.

CPC ..... *B65B 65/00* (2013.01); *B65B 43/26* (2013.01); *B65B 63/02* (2013.01); *B65D 33/001* (2013.01); *B65D 33/007* (2013.01); *B65D 2203/00* (2013.01)

(58) Field of Classification Search

CPC ..... B65B 65/00; B65B 43/26; B65B 62/02; B65D 33/001; B65D 33/007; B65D 2203/00

USPC ..... 206/83.5, 459.5, 459.1; 383/103, 100

See application file for complete search history.

(56) References Cited

U.S. PATENT DOCUMENTS

| | | | | |
|---|---|---|---|---|
| 584,659 | A * | 6/1897 | Appel | 383/9 |
| 983,492 | A * | 2/1911 | Harriss | 206/83.5 |
| 2,631,629 | A * | 3/1953 | Lee | 383/22 |
| 3,524,782 | A * | 8/1970 | Buske | 206/460 |
| 4,966,286 | A * | 10/1990 | Muckenfuhs | 206/494 |
| 5,628,168 | A | 5/1997 | Inman et al. | |
| 5,810,706 | A * | 9/1998 | McDonald et al. | 383/35 |
| 6,148,587 | A * | 11/2000 | McDonald et al. | 53/255 |
| 6,332,711 | B1 * | 12/2001 | Inuzuka et al. | 383/9 |

(Continued)

FOREIGN PATENT DOCUMENTS

| | | |
|---|---|---|
| JP | 01-020410 U | 2/1989 |
| KR | 20-0355927 Y1 | 7/2004 |

OTHER PUBLICATIONS

International Search Report completed May 31, 2010 and mailed Jul. 1, 2010 from corresponding International Application No. PCT/US2009/065997, filed Nov. 25, 2009 (3 pages).

(Continued)

*Primary Examiner* — Chun Cheung

(74) *Attorney, Agent, or Firm* — Klein, O'Neill & Singh, LLP

(57) ABSTRACT

A bag retrieval assembly and bag, which facilitates the covering of a bale of cotton or other fibrous material, are discussed. The bag is configured to be used with the bag retrieval assembly, which is configured to manipulate the bag from a stacked or stored configuration to an open configuration that may be raised and held into a position for further processing.

33 Claims, 29 Drawing Sheets

(56) References Cited

U.S. PATENT DOCUMENTS

| | | | | |
|---|---|---|---|---|
| 7,013,625 | B2 | 3/2006 | Curles | |
| 7,093,978 | B2 * | 8/2006 | Tan | 383/37 |
| 7,886,904 | B1 * | 2/2011 | Evans | 206/321 |
| 2004/0190796 | A1 * | 9/2004 | Main et al. | 383/9 |
| 2005/0031229 | A1 * | 2/2005 | Tang | 383/103 |

OTHER PUBLICATIONS

Written Opinion completed May 31, 2010 and mailed Jul. 1, 2010 from corresponding International Application No. PCT/US2009/065997, filed Nov. 25, 2009 (5 pages).

International Preliminary Report on Patentability completed May 31, 2011 and mailed Jun. 9, 2011 from corresponding International Application No. PCT/US2009/065997, filed Nov. 25, 2009 (8 pages).

* cited by examiner

BAG RETRIEVAL ASSEMBLY AND BAG FOR PRESSED BALES

This is a regular utility application of provisional application Ser. No. 61/118,175, filed Nov. 26, 2008, which expressly incorporates by reference U.S. provisional Application Ser. No. 61/033,376, filed Mar. 3, 2008.

BACKGROUND

Conventionally, manual labor has been used to cover a bale of cotton or other fibrous material with a bag to protect the bale from damage or contamination during transport, and some instances to comply with trade requirements. To bag a bale using prior art methods, one or, more commonly, two or more workers must extend an open end of a bag over a bale chute in preparation for the bale to be inserted through the bale chute and into the bag, preventing the workers from accomplishing other tasks during this time. Conventional bale bagging devices also contain numerous moving parts, on which workers may catch themselves or clothing, causing serious injuries, death, and/or property damage.

SUMMARY

The present invention provides a bag retrieval assembly and bag, which facilitate the covering of a bale of cotton or other fibrous material. The bag is configured to be used with the bag retrieval assembly, which is configured to manipulate the bag from a stacked or stored configuration to an open configuration that may be raised and held into a position for further processing. The present invention may reduce manual labor requirements, protect the bale from damage or contamination during transport, and in some instances, help to comply with trade requirements.

In one aspect, a bag is provided which includes a body portion having a bottom end, opposed first and second panels extending from the bottom end, and opposed first and second side panels extending from the bottom end and connecting the first and second panels. The bottom end, the first and second panels and the first and second side panels are assembled together to define a receptacle space. The receptacle space has an open end located opposite the bottom end. The bag also includes a cutout portion defined on the first panel. The cutout portion is positioned at a location on the first panel more proximate to the open end than to the bottom end. The bag may also include a mark positioned proximate to the cutout portion, such that the mark provides an indication of the location of the cutout portion, for example, to a visualization system.

Also provided herein is a bag for bagging a pressed bale comprising a body portion having a bottom end, opposed first and second panels each comprising an exterior surface and an interior surface extending from the bottom end, and opposed first and second side panels extending from the bottom end and connecting the first and second panels; the bottom end, the first and second panels and the first and second side panels defining a receptacle space with an open end located opposite the bottom end. A cutout portion is formed through the exterior surface and the interior surface of the first panel, the cutout portion positioned at a location on the first panel nearer the open end than the bottom end; and wherein when the open end is closed, the cutout is covered on the interior surface side by the interior surface of the second panel.

In another aspect, a bagging system is provided including a bag retrieval assembly for retrieving a bag, a bag positioning assembly for opening the bag retrieved by the bag retrieval assembly and preparing the bag to receive a bale, and a bag stuffing assembly for inserting the bale into the bag. The bag retrieval assembly includes a robotic device configured to move along variable paths to variable positions; and an end effector coupled to the robotic device. The end effector includes a beak assembly, and a visualization system configured to detect and isolate features of a digitized image. The beak assembly and the visualization system are each mounted generally in-line along a central axis of end effector.

In yet another aspect, a method for retrieving a bag for use in a bagging system is provided. The method includes detecting a cutout defined on a first side of a bag; moving a beak assembly having a first arm and a second arm into a position proximate to the cutout; inserting at least a tip of the first and second arms into the cutout; and expanding the beak assembly until the distance between the tips of the first and second arms is greater than the diameter of the cutout.

In still yet another embodiment, a method for retrieving a bag for use in a bagging system is disclosed. The method comprising detecting an indicium defined on an exterior surface of a first side of a bag; moving an end effector towards the indicium; deploying an attachment device mounted on the end effector to grab the bag; and wherein the attachment device comprises a vacuum source.

In yet another embodiment, a method for retrieving a bag and placing a pressed bale into the bag is provided. Said method comprising the steps: moving a pressed bale into a bale bagging assembly; inserting a probe into a cut section of a bag, said bag sized for bagging a pressed bale; opening an open end of the bag; moving the bag and the probe relative to one another to separate the bag from the probe; and moving the pressed bale into the bag through the open end of the bag.

Other aspects and variations of the bag and bag retrieval assembly summarized above are also contemplated and are more fully understood when considered with respect to the following disclosure.

DETAILED DESCRIPTION

The detailed description set forth below in connection with the appended drawings is intended as a description of the presently preferred embodiments of a bag and a bag retrieval assembly provided in accordance with aspects of the present invention and is not intended to represent the only forms in which the present invention may be constructed or utilized. The description sets forth the features and the steps for constructing and using the bag and bag retrieval of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like or similar elements or features.

Figure 1:
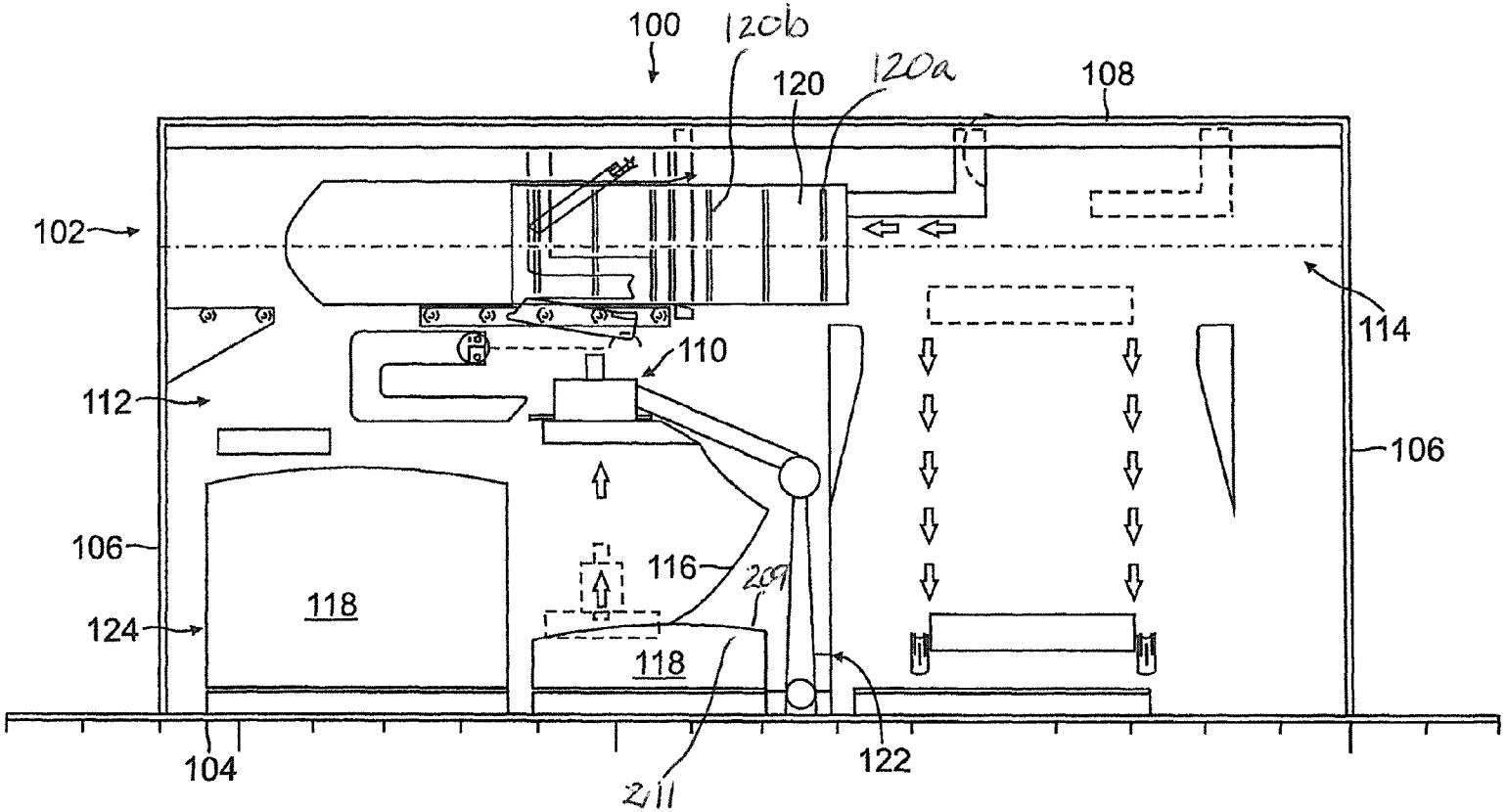
FIG. 1 is aside schematic view of an exemplary embodiment of a bagging assembly including a bag retrieval assembly in accordance with embodiments of the present invention.

To facilitate an understanding of the embodiments of the bag and bag retrieval assembly of the present invention, the general architecture and operation of a preferred bagging assembly is described, which is disclosed in Ser. No. 61/033, 376 and previously incorporated herein by reference. FIG. 1 is a simplified illustration of a bagging assembly 100, which provides a means to efficiently and effectively insert an uncovered pressed and strapped bale of fibrous material into a bag, seal the bag, and transport the sealed bag away from the bagging assembly.

In an exemplary embodiment, bagging assembly 100 includes a system area 102, which houses various bale bagging components generally referred to herein as a housing, having abase 104, that may be a floor or a slab or a metal frame or foundation, side walls 106, that may be metal, plastic, wood or steel frames or steel beams, and a top wall 108, that may be a roof of a building or an upper frame or beam.

Bagging assembly 100 includes, within housing 102, a bag retrieval assembly 110 for retrieving bags from a stack of bags 118, a bag positioning assembly 112 for opening the bag and preparing the bag over a chute to receive a bale, and a bag stuffing assembly 114 for stuffing or inserting the strapped bale into the bag. Generally speaking, bagging assembly 100 operates continuously to retrieve a bag 116 from a stack of bags 118, position bag 116 to receive a bale 120 having at least two straps 120*a*, 120*b*, insert bale 120 into bag 116, seal bag 116, and push the sealed bag off of the assembly to then bag a next bale. The foregoing description is described in detail in provisional application No. 61/033, 376.

Figure 2A:
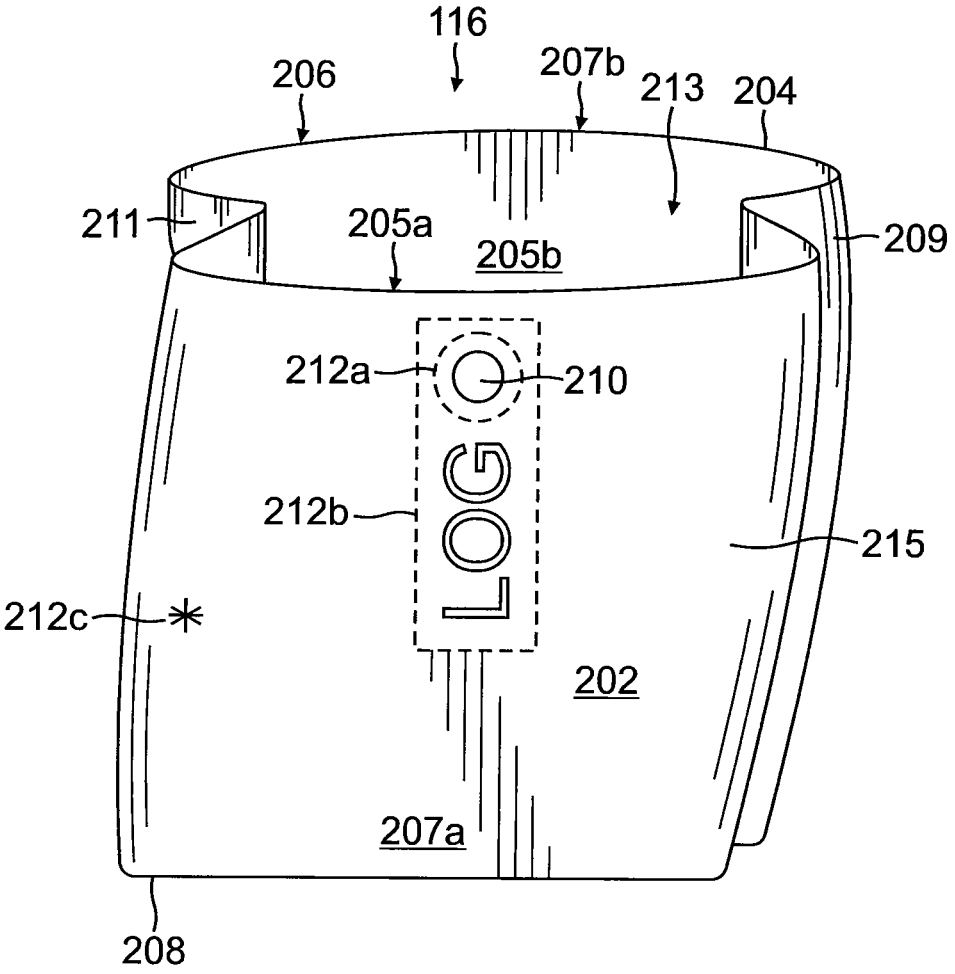
FIG. 2A is a simplified view of an exemplary bag for use with the bag retrieval assembly in accordance with an embodiment of the present invention.

FIG. 2A is a simplified perspective view of bag 116 for use with bag retrieval assembly 110 in accordance with an embodiment of the present invention. With continued reference to FIG. 1 and now with reference to FIG. 2A, in one embodiment, bag 116 includes a body having a first panel, side, or layer 202 and a second panel, side, or layer 204, which extend from a bottom end or closed end 208. Bag 116 also includes first side panel 209 and second side panel 211, which also extend from bottom end 208 and connect first panel 202 to second panel 204. Bottom end 208, first and second panels 202 and 204 and first an second side panels 209 and 211 together define a generally elongated receptacle space 213 with an open end 206 located opposite bottom end 208. In one embodiment, bag 116 may be provided with a substantially flat bottom end 208, folded gussets formed in the first and second side panels 209 and 211, and one or more horizontal folds or creases 215 so that bag 116 may be folded and unfolded, into two or more folds, between the use and storage configurations.

Bag 116 may be formed by folding and assembling a length of material, using adhesives, heat or pressure welding, sewing or other well known bag assembling techniques. The length of material may include, but is not limited to plastic, burlap, cotton, nylon, polypropylene, polyethylene, polyester, paper, or similar bag making materials. Bag 116 may be adapted so that the body of the bag is convertible between an expanded use configuration (FIG. 2A), which shows the first and second side panels 209 and 211 partially expanded, and a collapsed storage (folded) configuration (stack 118, FIG. 1), which shows wherein the first and second side panels 209, 211 each folded when the open end is closed.

A hole or cutout 210 is formed on and extends through first panel 202 of bag 116. It should be understood that the position of cutout 210 on first panel 202 is governed, at least in part, by movement and operation of the bag retrieval assembly 110 for "picking-up" bag 116, as described in detail below. Generally, however, cutout 210 may be positioned on first panel 202 in relative proximity to open end 206 of bag 116. In one embodiment, cutout 210 is positioned closer to open end 206 than to bottom end 208. Most preferably, the cutout 210 is located on only one of two panels, such as the first panel 202 and not also the second panel 204. Also, when the bag is in a closed configuration and laid flat, the cutout 210 is superimposed against a solid surface layer of the second panel 204. Although other cutouts may be incorporated elsewhere on bag 116, the main cutout 210 on the first panel should not have a corresponding cutout located on the second panel. This allows a pickup to grab the bag 116 by only one of its side panels, as further discussed below. In a broadest aspect of the present invention, an indicium is provided on an exterior surface of the first panel 202 for use by a detection system to move towards the bag to then enable a retrieving device to grab the bag. The indicium can be a cutout, several cutouts, a mark, a combination mark and cutout, a logo, a hook, a notch, a metal insert, a sensor, a radio frequency identification (RFID) member, combinations thereof and similar devices to enable detection by a detection system. In one example, a support grommet is added to a bag having a cutout to facilitate pickup by allowing additional detection mechanism to key in on the grommet. The grommet can also add strength or texture to a less sturdy bag. As used herein, a cutout or a slit can be used interchangeable. More generically, a "cut section" may include a cutout or a slit or other cut features, such as a stamped section, a ripped section, a punched section, etc.

Figure 2B:
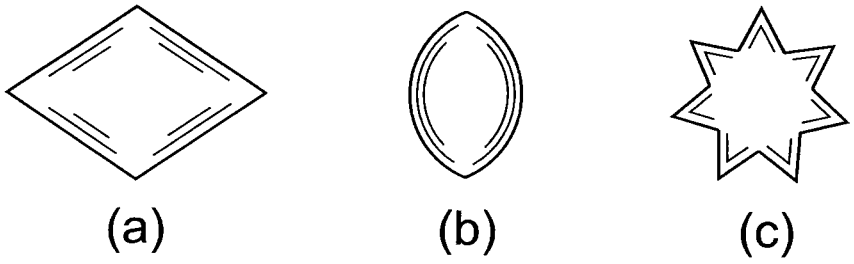
FIG. 2B(a)-(c) are illustrations of exemplary cutout features for use with the bag of FIG. 2A in accordance with an embodiment of the present invention.

In one embodiment, an indicator or mark may be placed on bag 116 to help locate or pinpoint the cutout 210 so that it is more "visible," especially to a camera system. OCR system, machine vision system or similar visualization systems, which uses the cutout and/or the indicator to locate a grabbing mechanism relative to the cutout to pick up the bag. For example, in one embodiment, cutout 210 may be encircled with a contrasting color band or other contrasting feature 212*a*, such as reflective coating or paint. In other embodiments, cutout 210 may be formed of varying geometrical shapes, features or combinations thereof. For example, with no intent to be limiting but only exemplary. FIGS. 2B(a)-(c) illustrate cutout 210 as a polygon, an ellipse, and a star. In yet another alternative embodiment, a specific mark 212*b*, such as a word or a logo may be positioned proximate to cutout 210, or may incorporate all or a part of cutout 210 into the mark 212*b*, to indicate the location of cutout 210. A mark 212*c* may be placed on first panel 202, such that when mark 212*c* is detected by the visualization system, the location of cutout 210 may be determined relative thereto. However, other schemes and devices or sensors for detecting edges, visual contrasts, marks, etc. may readily be used without deviating from the spirit and scope of the present embodiment.

Bag 116 is stacked on stack of bags 118, such that first panel 202 and cutout 210 are exposed at the top of stack 118 to be accessed by bag retrieval assembly 110 (FIG. 1). In some embodiments, bag 116 and other bags in the stack of bags 118 may be folded when stacked and aligned in uniform fashion, e.g., with the open end of each bag oriented in the some direction. Alternatively, the first panel 202 and cutout 210 may alternate along two different ends of the stack of bags so that the bag retrieval assembly 110 has to traverse back and forth to pick up the next succeeding top bag on the stack of bags. Other possibilities include random stacking so that the indicia of each bag varies, stacking the bags in organized manner but in multiple stacks, stacking the bags in smaller folds, similar to stacked shirts found at department stores, etc. Where appropriate, nesting between two adjacent stacks as shown in FIGS. 3A and 3B, or grid stacking as shown in FIGS. 3C and 3D may be used. Still in other embodiments, the plurality of bags are provided in a roll format and mounted on a, tube, spindle or shaft for individually removing a bag from the roll of bags. In yet another embodiment, the stack of bags may be stacked in any order and fashion provided the cutout or 210 is exposed a sufficient amount to be accessed by a pickup probe.

Figure 3:
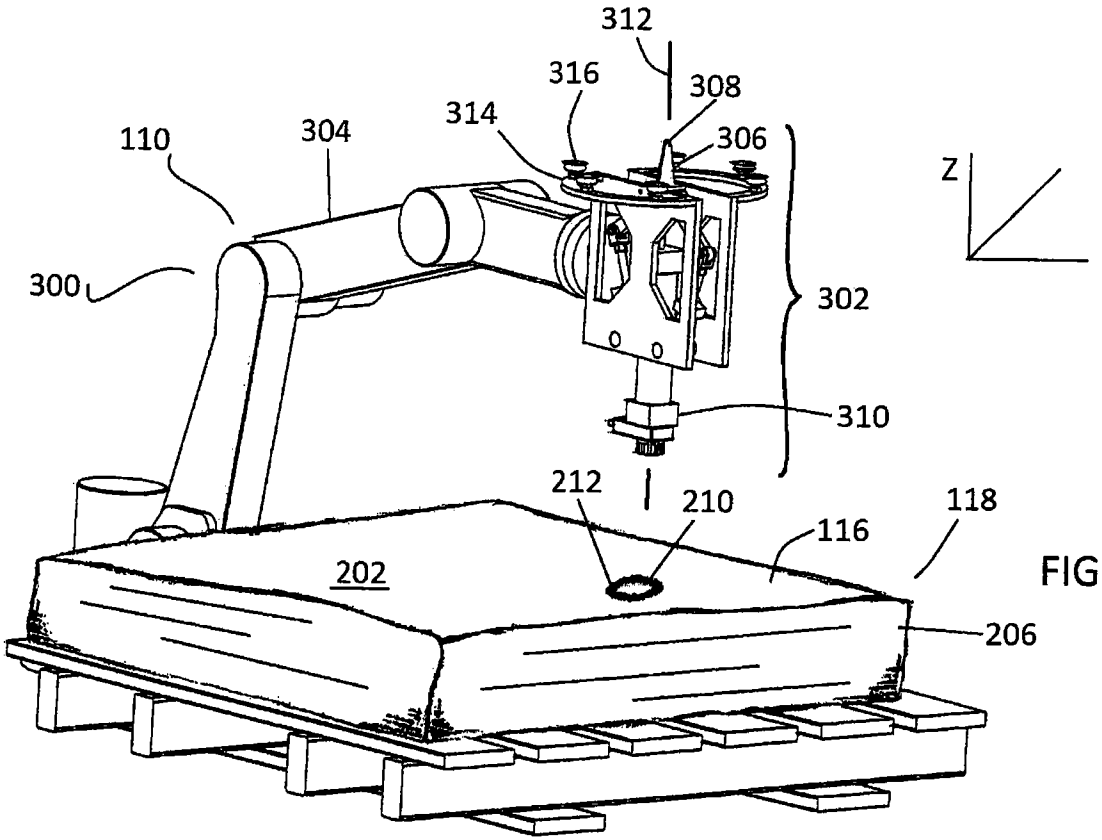
FIG. 3 is a view of a bag retrieval assembly in accordance with an embodiment of the present invention.
Figure 3B:
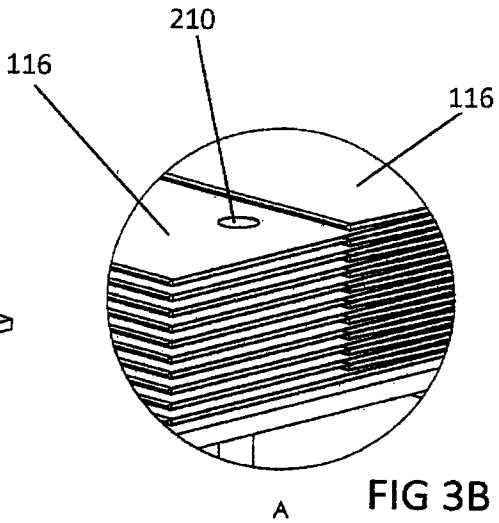
FIGS. 3A-3D are schematic views of alternative stacks of bags located on a support, such as a palette.
Figure 3A:
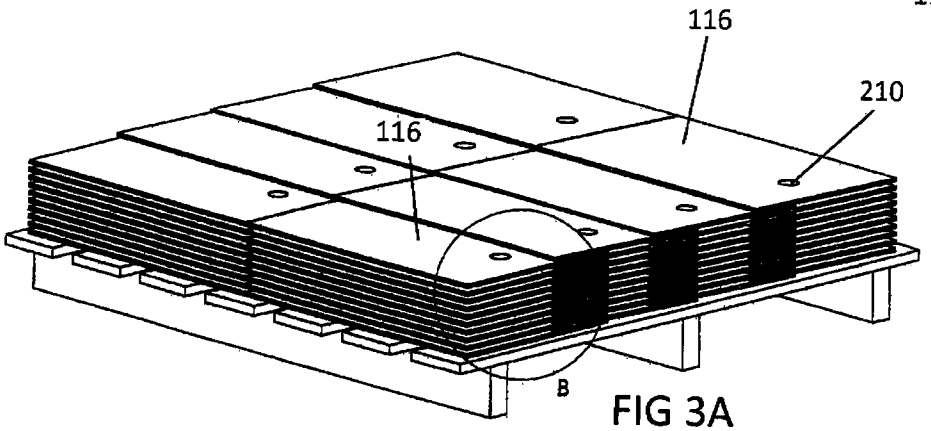
Figure 3D:
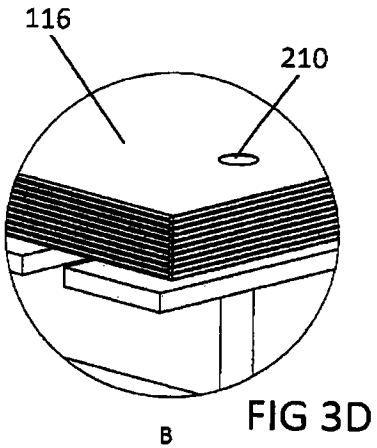
Figure 3C:
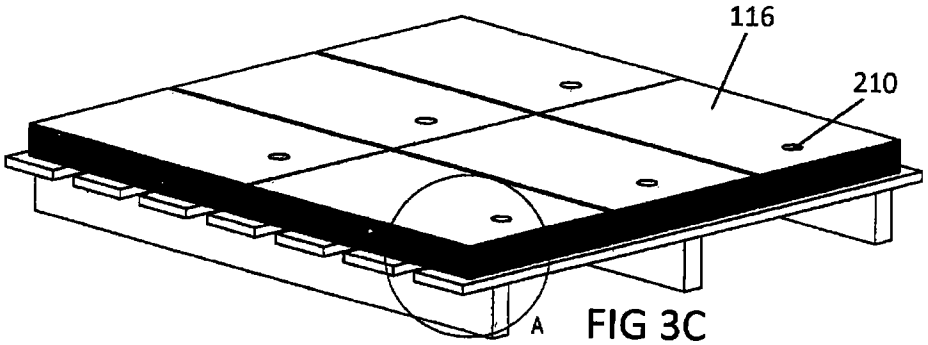

FIG. 3 is a perspective view of bag retrieval assembly 110 configured for use to "pick-up" a bag 116 from a stack of bags located on a support 119, such as a palette, and lift the bag into place for further processing by the bagging assembly (FIG. 1) in accordance with an embodiment of the present invention. With continued reference to FIGS. 1 and 2A and also now with reference to FIG. 3, bag retrieval assembly 110 includes a robotic device 300, including an end effector 302, disposed at the end of a robotic arm 304, and adapted to locate and pickup bag 116 as described below. With reference to FIG. 1, the robotic device 300 is understood to be located in the vicinity of the stack of bags 118. As further discussed below, the robotic device 300 may move along multiple axes, just one axis, or is stationary when retrieving the bag. Alternatively or in addition to movement by the robotic device 300, the pallet or stack of bags 118 may be configured to move in the X, Y, and/or Z directions to effect the same results, such as moving to the fixed robotic device to then permit the end effector to pick up the bag.

End effector 302 may be manipulated with robotic arm 304 using well-known robotic motion techniques controlled by a computer, vector drives, servo drives, electro mechanical sensors and/or other common control devices known in the art. These controllers may be closely placed, producing a master control center, or each device may have its own controller, wherein signals coordinate functions between systems. Alternatively, a Cartesian coordinate robot may be used to move the end effector to perform the bag pickup function, as further discussed below.

Figure 4:
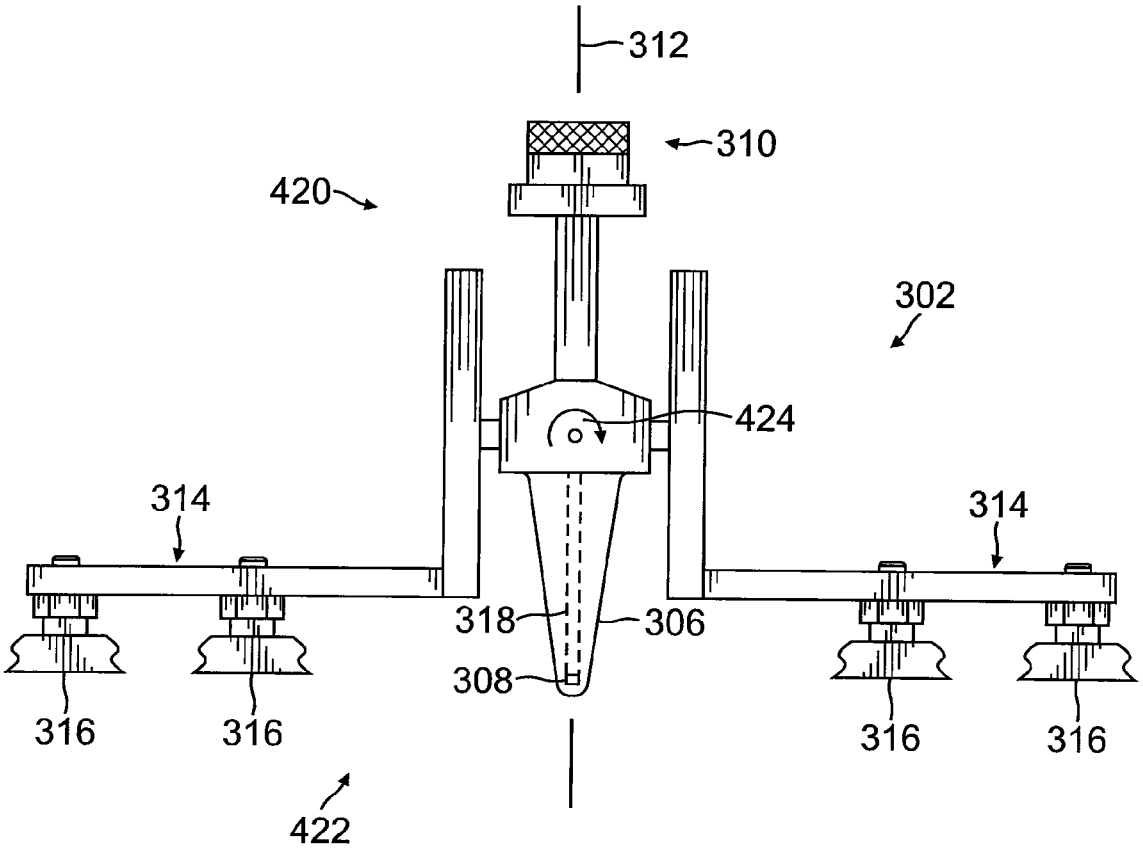
FIG. 4 is a simplified illustration of an end effector in accordance with an embodiment of the present invention.

In one embodiment, with reference to FIG. 4, end effector 302 includes a beak assembly 306, at least one nozzle 308 formed at a tip of beak assembly 306, a conduit 318 (shown in phantom) and visualization system 310, each mounted generally in-line along a central axis 312 of end effector 302. An exemplary visualization system 310 is a DVT Smartimage System, which is a division of Cognex Corporation of Natick, Mass. It should be understood that some components necessary to support the mechanical or electrical operations of beak assembly 306, such as various linear drive mechanisms, gears, servos, motors and the like and visualization system 308, such as electronic support equipment, may also be co-located on end effector 302, although they are not shown in FIG. 3 for clarity.

As shown in FIG. 4, beak assembly 306 and visualization system 310 are positioned to operate at opposite ends 420 and 422 of the end effector, and in opposite directions relative to each other. The "working end" of end effector 302 is considered end 420 or end 422 that is "facing" or directed at the target to be retrieved, for example, bag 116. Depending on the operation, either end 420 or end 422 will face the target. To place beak assembly 306 and visualization system 310 at the working end of end effector 302, the end effector may be rotated at least 180 degrees as indicated by arrow 424, or along some other a pivot point or axis located on the end effector.

A bag attachment mechanism 314 may also be coupled to end effector 302 and used to secure bag 116 to end effector 302. In one exemplary embodiment, bag attachment mechanism 314 may include a vacuum device capable of generating an effective amount of vacuum so that as end effector 302 is raised, bag 116 is held by a vacuum force and rises with the end effector. For example, bag attachment mechanism 314 may include a plurality of vacuum cups 316 used to ensure that bag 116 is secured to end effector 302. Alternatively, a perforated vacuum plate, or any other device suitable to enable end effector 302 to "grab" bag 116 to be removably attached to end effector 302 may also be used as an alternative to, or in addition to, vacuum device 314. In one embodiment, a sensor (not shown) may be incorporated into end effector 302 so that as it contacts bag 116, a signal is sent to a controller to activate vacuum device 314.

Referring now to FIGS. 3 and 4, in one embodiment, end effector 302 may be lowered such that visualization system 310 at the working end of end effector 302 is made to face first panel 202 of bag 116. Visualization system 310 may include for example a camera, an OCR device, a machine vision device or the equivalent, capable of detecting and isolating desired portions, shapes, or features of a digitized image or video stream of first panel 202. In one embodiment, robotic arm 304 is configured to position end effector 302, with visualization system 310 facing first panel 202 of bag 116, along variable paths to variable positions relative to cutout 210, such that visualization system 310 may detect and isolate desired portions or features of cutout 210 and mark 212. For example, in one embodiment, visualization system 310 detects a contrasting color band 212 encircling cutout 210. A signal is sent to the robotic controllers and in response, the robotic controllers cause robotic arm 304 to move end effector 302 into a desired position relative to cutout 210. For example, end effector 302 is moved to align its central axis 312 with the geometric center of cutout 210. Once in position, the position of end effector 302 in the x, y plane is fixed or locked.

Alternatively, visualization system 310 may be used to detect other features of bag 116, other than cutout 210. For example, visualization system 310 may detect a logo or word, a geometric feature, a plurality of geometric features, a tag and the like, located away from cutout 210. Detection of one of these alternative features may cause a signal to be sent to the robotic controllers, which in turn, causes the controllers to manipulate end effector 302 into a desired position relative to cutout 210. Generally, the desired position is where central axis 312 of end effector 302 and visualization system 310 are substantially in direct alignment with the geometric center of cutout 210.

Figure 5A:
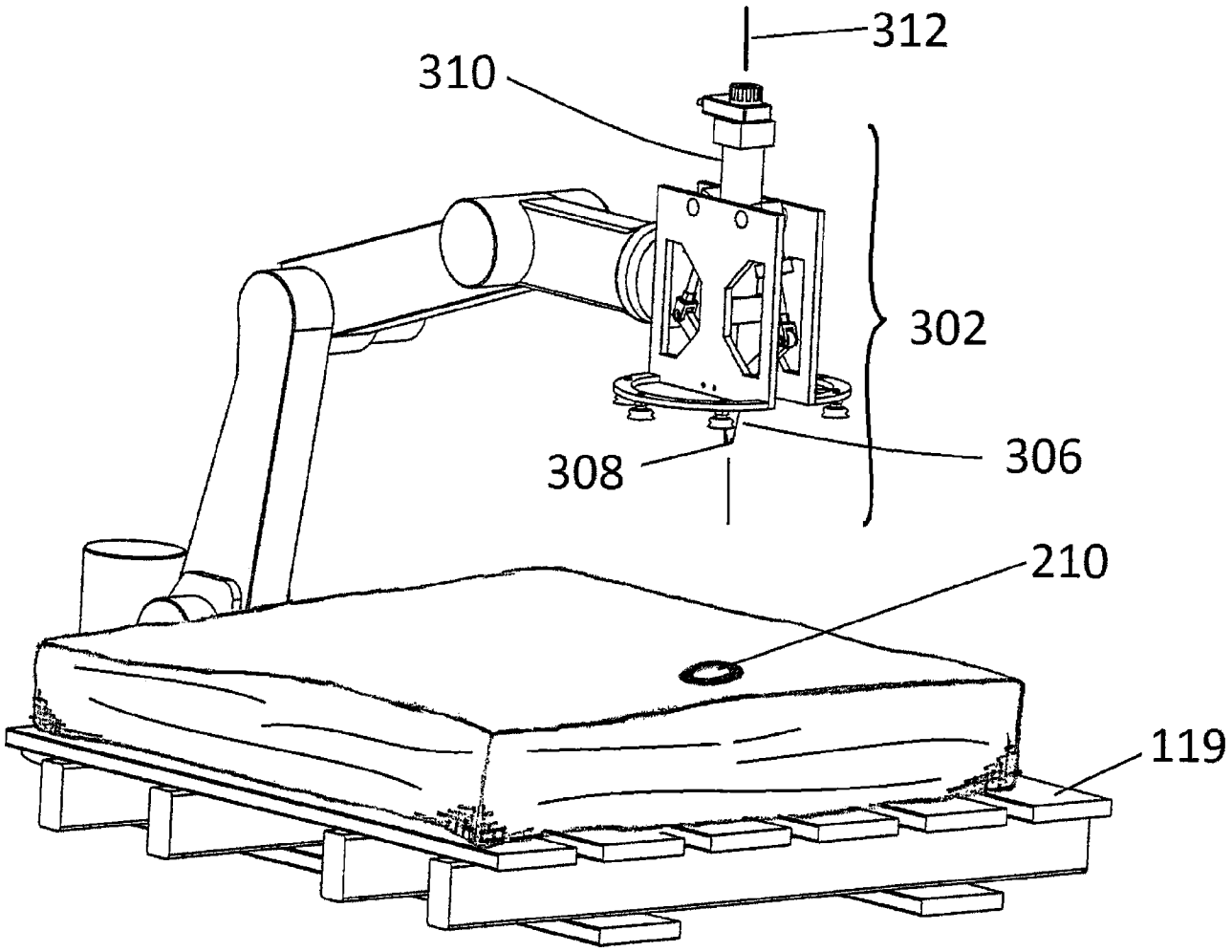
FIGS. 5A and 5B are simplified views showing the deployment of the end effector in accordance with an embodiment of the present invention.

With reference now to FIG. 5A, once in its fixed position above cutout 210, end effector 302 is made to rotate 180 degrees (arrow 424, FIG. 4), to cause beak assembly 306 and nozzle 308 to rotate toward bag 116, which then becomes the working end. After this rotation of end effector 302, beak assembly 306 and nozzle 308 are now directed at first panel 202 of bag 116. In this position, central axis 312 of beak assembly 306 is substantially in direct alignment with the geometric center of cutout 210.

Figure 5B:
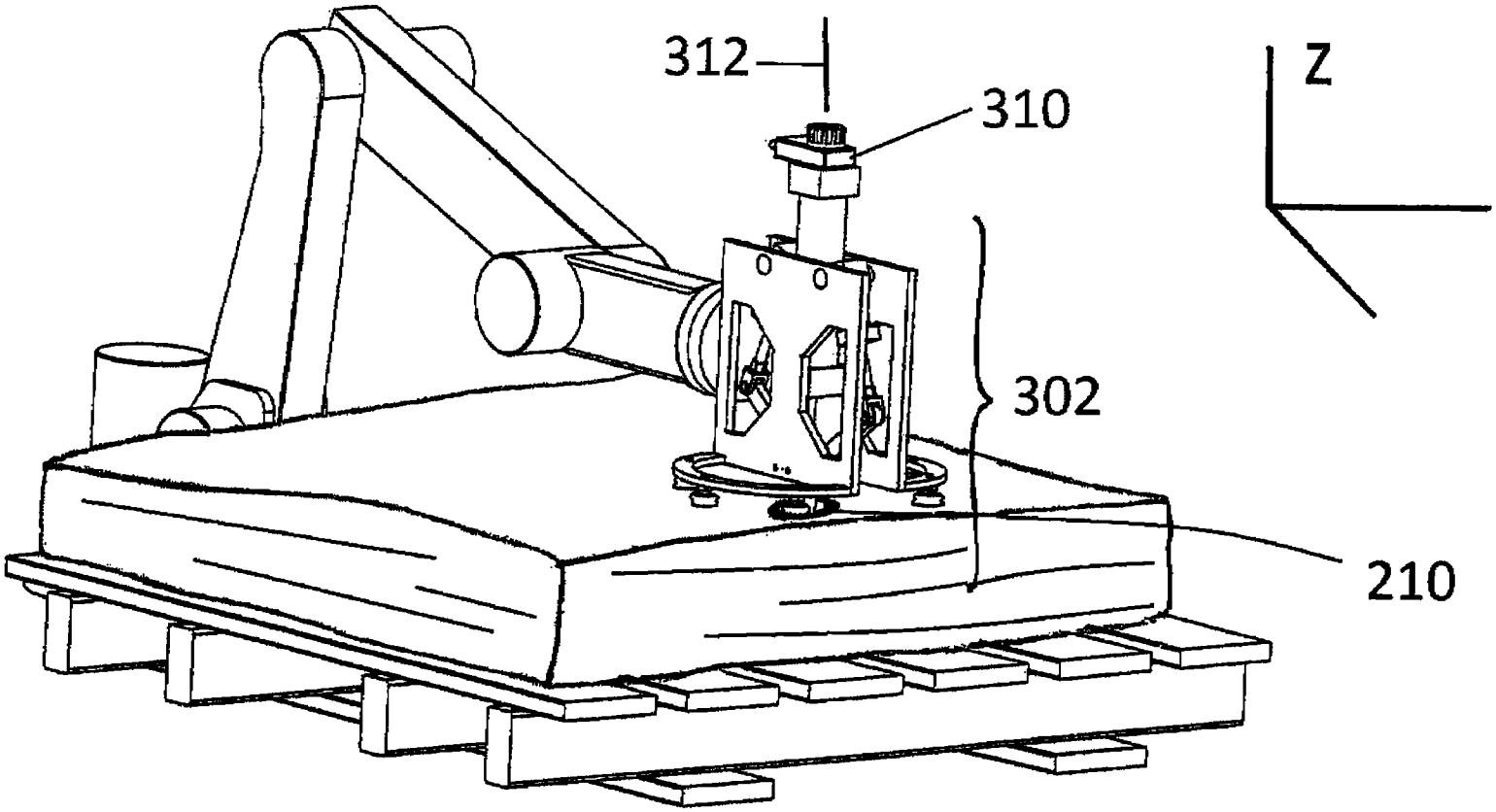

As shown in FIG. 5B, once beak assembly 306 is positioned above cutout 210, end effector 302 may be lowered along the z-axis to grip the bag. End effector 302 is lowered until at least a portion of beak assembly 306 protrudes through cutout 210. Generally, the portion of beak assembly 306 that enters cutout 210 protrudes through cutout 210 to a depth necessary to ensure that nozzle 308 passes through cutout 210 and into the interior of bag 116. The end of beak assembly 306 is usually moved until it contacts second panel 204 of bag 116 and uses the contact on the second panel as a leverage to open the open end of the bag, as further discussed below.

Figure 6A:
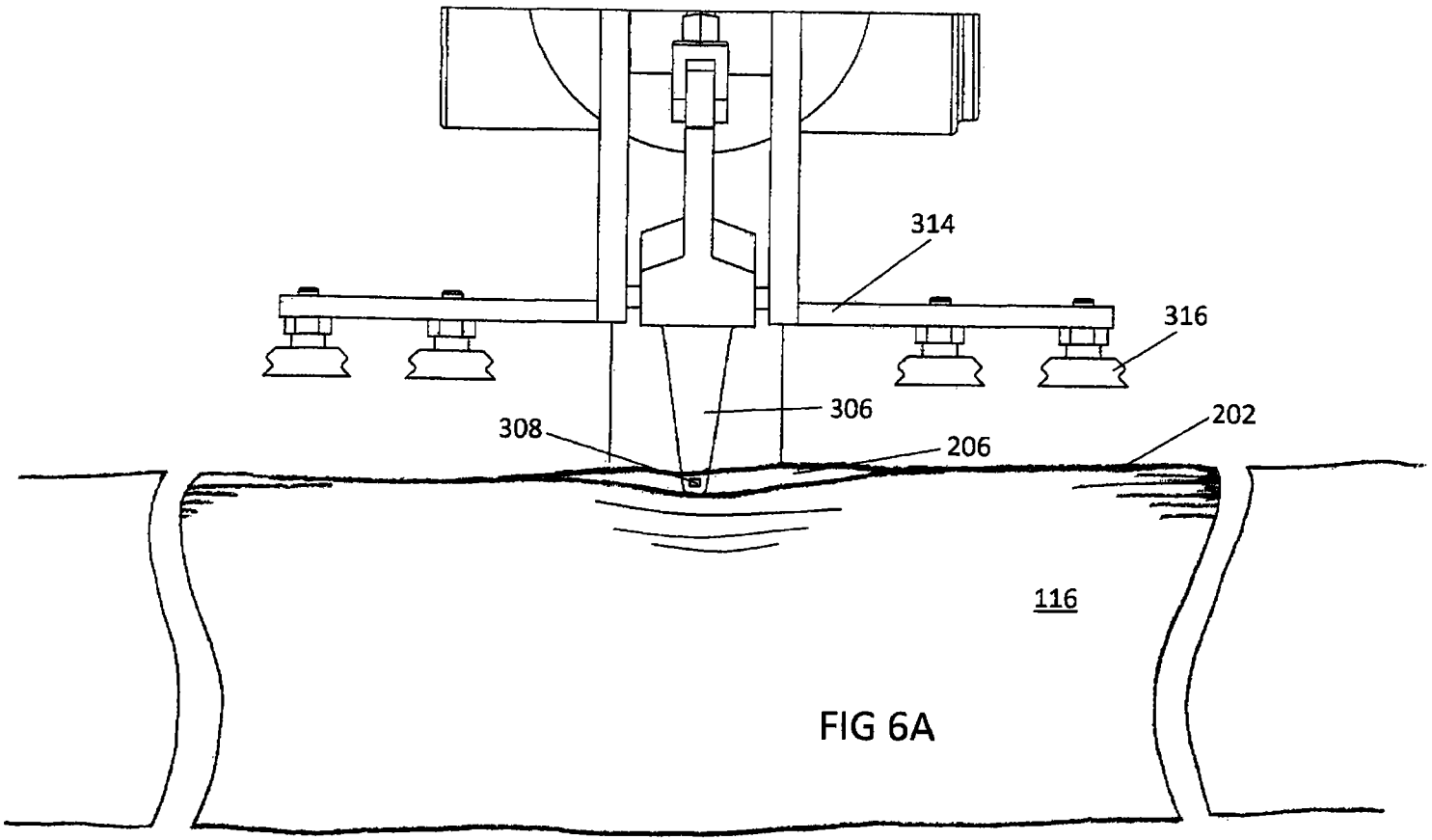
FIGS. 6A and 6B are simplified front views of a beak assembly after entering into the cutout in accordance with an embodiment of the present invention.

FIG. 6A is a simplified view of open end 206 of bag 116 after at least a portion of beak assembly 306 enters into cutout 210. As show in FIG. 6A, nozzle 308, positioned at the end or tip of beak assembly 306, enters into the interior of bag 116. In one embodiment, a gas, such as air, is introduced into an inner cavity (not shown) of beak assembly 306 through, for example, conduit 318 (FIG. 4) until the air reaches nozzle 308.

Figure 6B:
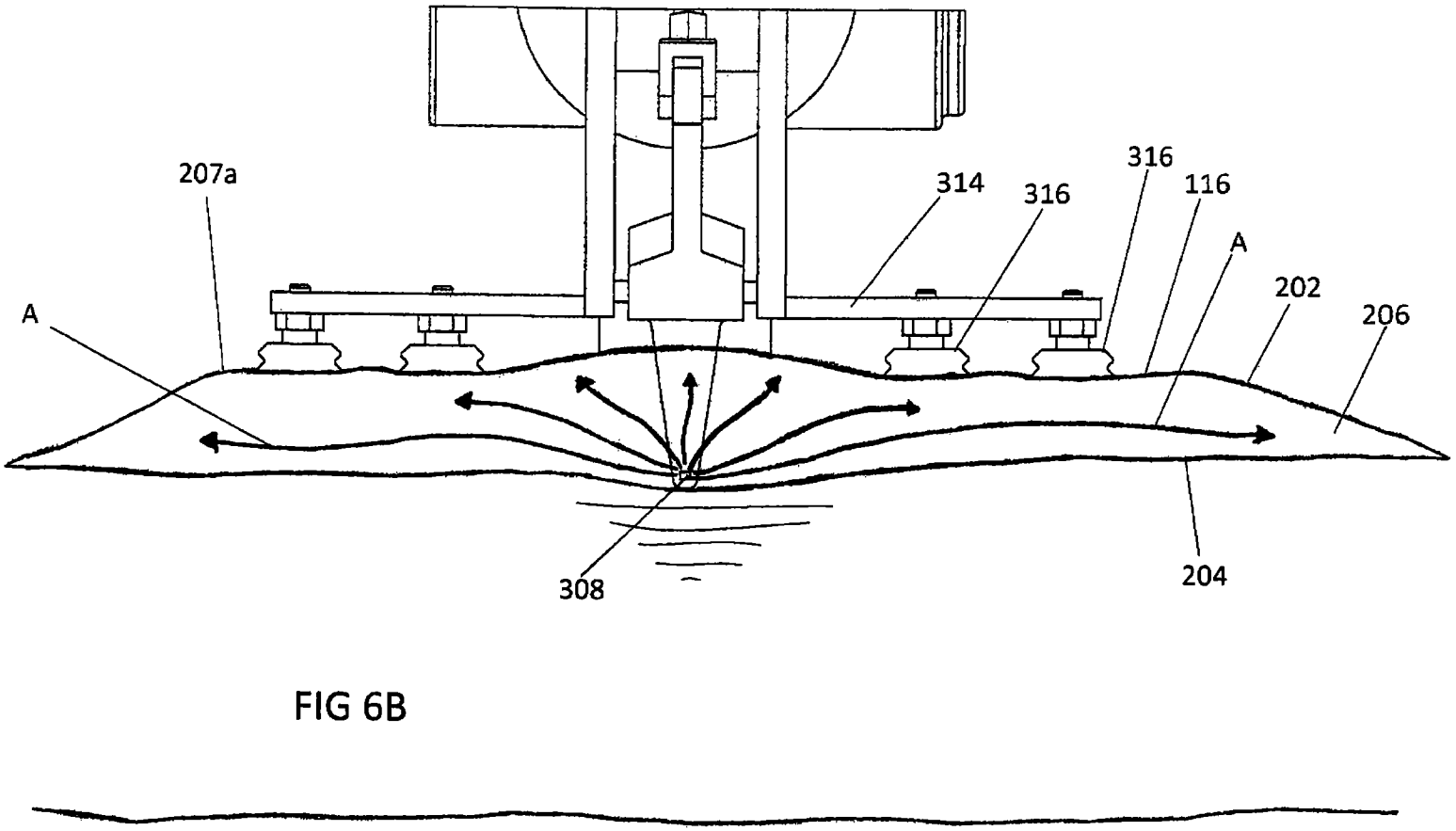

As shown in FIG. 6B, gas A exits nozzle 308 to cause bag 116 to open or inflate. The inflation causes the otherwise touching interior surfaces 205*a* and 205*b* (FIG. 2) of first and second panels 202 and 204 to separate causing bag 116 to open. In addition, the inflation causes first panel 202 to rise relative to end effector 302 until an exterior surface 207*a* of first panel 202 contacts vacuum device 314, in this embodiment, vacuum cups 316. In one embodiment, vacuum is supplied to the cups 316 at the same time air is forced through the exit nozzle 308 so that as the first panel 202 flails from the purged air and touches the vacuum cups, it is grabbed by the cups. Alternatively, vacuum may be sequenced to open slightly before or slightly after the air flow to produce vacuum at the cups. Vacuum pressure may be supplied using a compressor, educator pump, generator, or any other well known vacuum producing apparatus or method. Accordingly, exterior surface 207*a* of first panel 202 of bag 116 adheres to vacuum cups 316 and is thus removably secured to end effector 302.

Figure 7A:
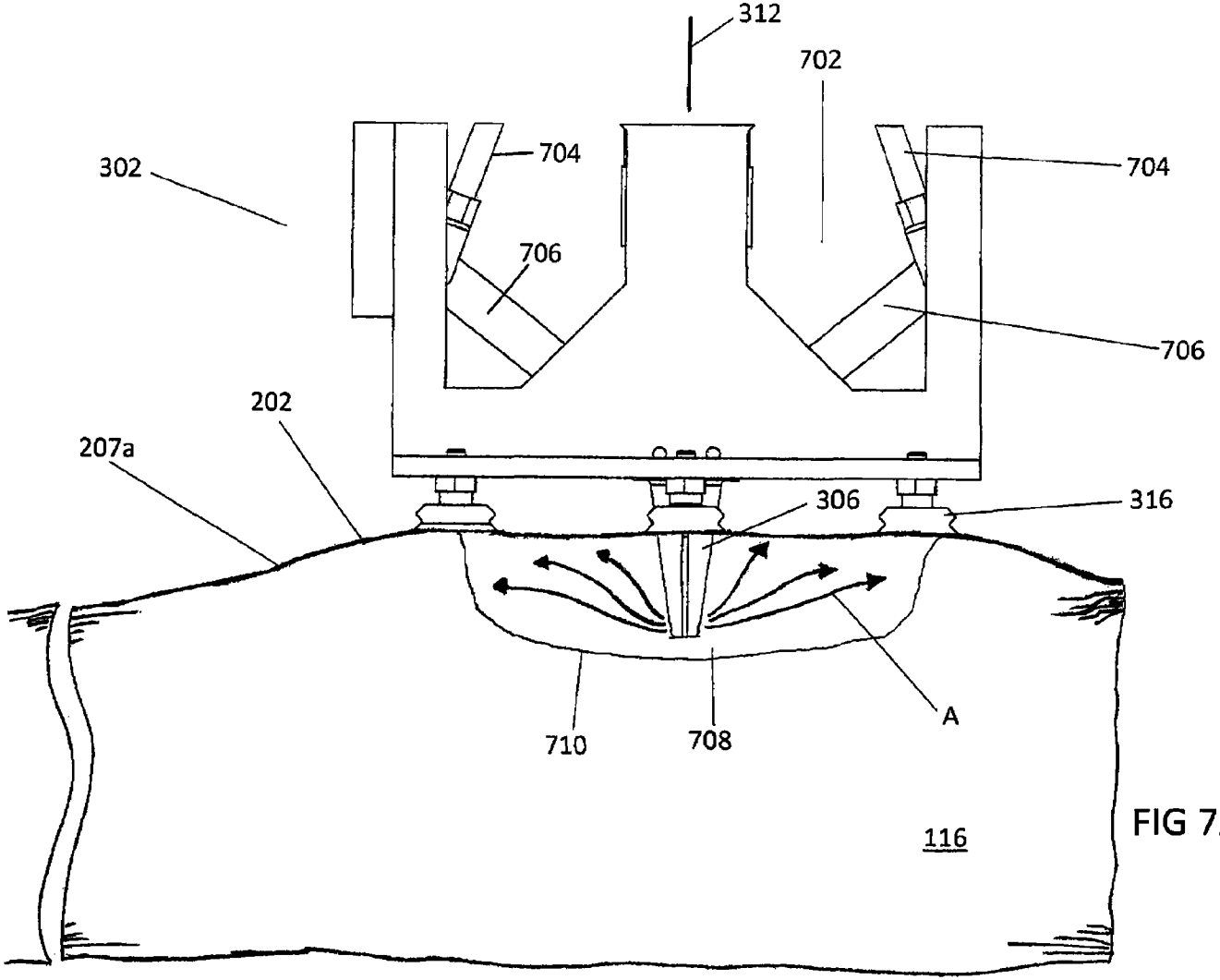
FIGS. 7A and 7B are simplified cutaway side views of a bag showing the beak assembly after entering into the cutout in accordance with an embodiment of the present invention.

FIG. 7A shows a cutaway side view of bag 116 showing beak assembly 306 in its inserted position through cutout 210 and into the interior of bag 116. Gas A may continue to flow until desired but at least until exterior surface 207*a* of first panel 202 has made contact with vacuum cups 316. As shown in FIG. 7A, beak assembly 306 includes two separate arms 708 and 710. Each arm may include a nozzle 308 for expelling gas introduced into beak assembly, such as through conduit 318. As also shown in FIG. 7A, end effector 302 includes a driving mechanism 702 coupled to beak assembly 306, which is used to cause beak assembly 306 to "open" or expand. Driving mechanism 702 may be any known combination of mechanical linkages, rods, motors, servos, gears or any pneumatic, hydraulic or other conventional method for opening or expanding the two arms 708, 710 of the beak assembly 306.

Figure 7B:
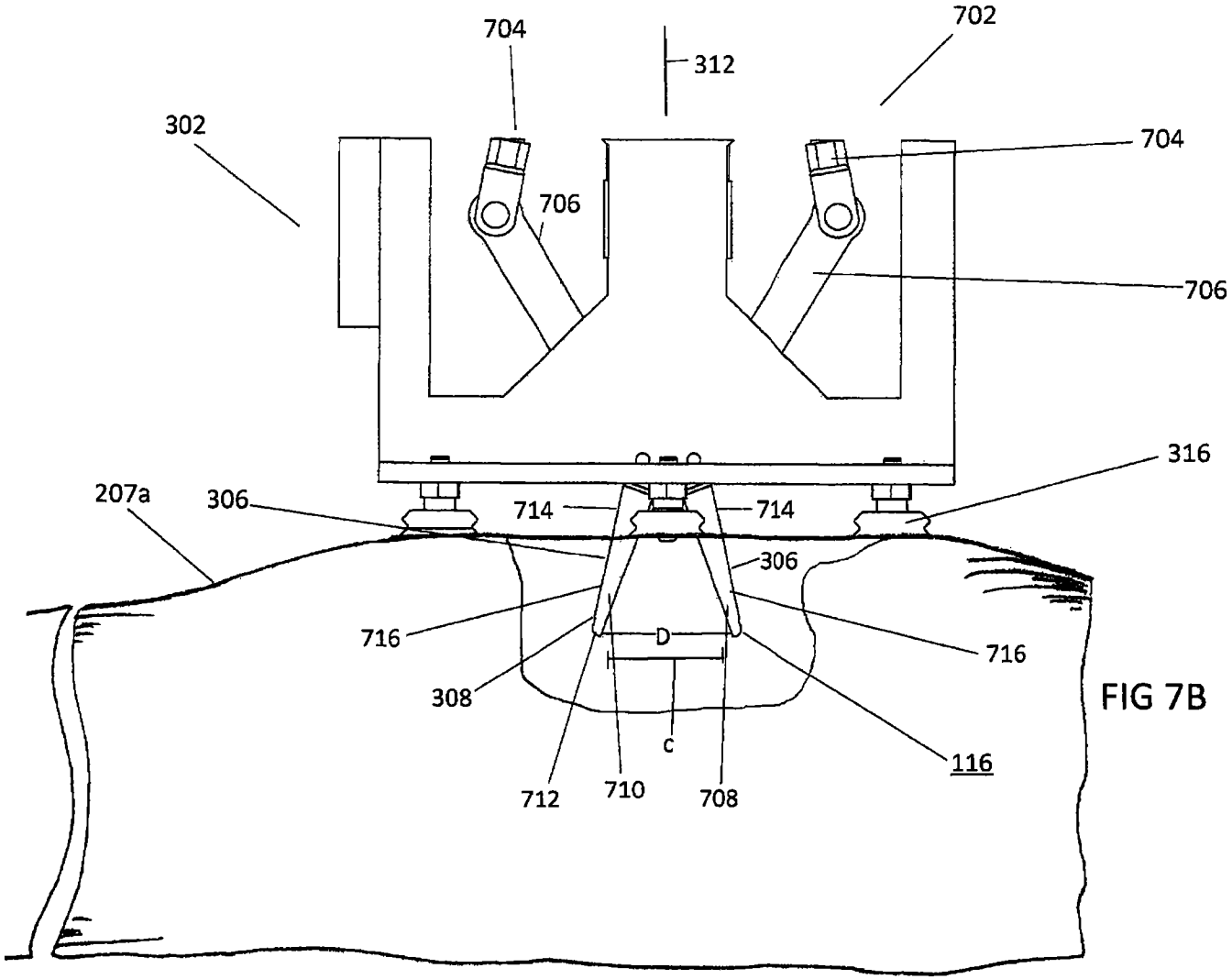

In one embodiment, driving mechanism 702 may include hydraulic or pneumatic cylinders 704 coupled to cylinder rods 706. In operation, when cylinders 704 are energized, rods 706 are made to retract, or expand depending on the mechanical configuration. As shown in FIG. 7B, the retraction causes tips 712 of first arm 708 and second arm 710 of beak assembly 306 to pivot away from center axis 312 and each other, about base 714 of each arm. Tips 712 of each arm may be separated a distance D during expansion.

In one operational embodiment, to aid in securing bag 116 to end effector 302, while beak assembly 306 is inserted into cutout 210, arms 708 and 710 may be expanded a distance D, which is greater than the diameter C of cutout 210. As arms 708 and 710 expand to distance D, an outer surface 716 of each arm 708 and 710 is made to contact an inner surface of cutout 210. The continuing expansion of arms 708 and 710 to distance D causes a portion of bag 116 proximate to cutout 210 to migrate up along arms 708 and 710. Because distance D is greater than diameter C of cutout 210, tips 712 and at least a portion of arms 708 and 710 are positioned securely within the interior of bag 116. The expanded tips 712 and arms 708 and 710 secure bag 116 to end effector 302.

Figure 8A:
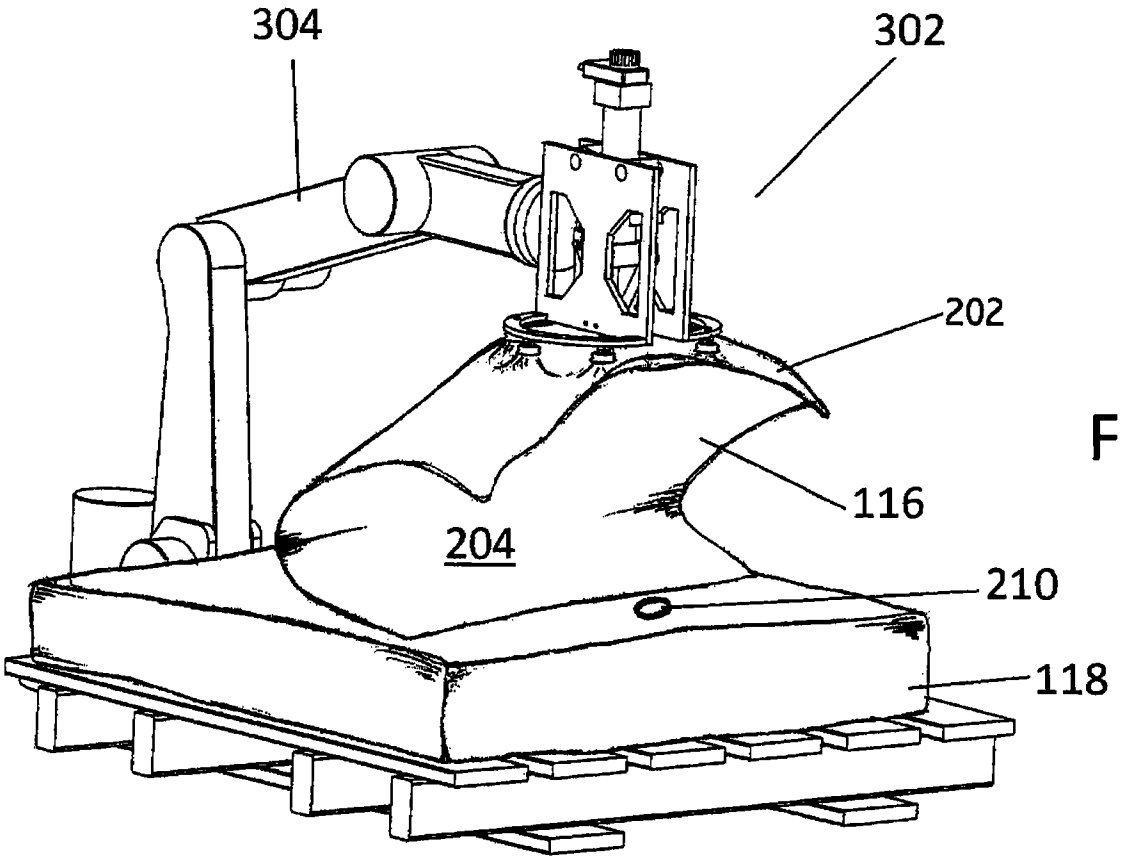
FIGS. 8A and 8B are simplified views of the bag retrieval assembly being used to pick-up a bag and lift the bag into place for further processing in accordance with an embodiment of the present invention.
Figure 8B:
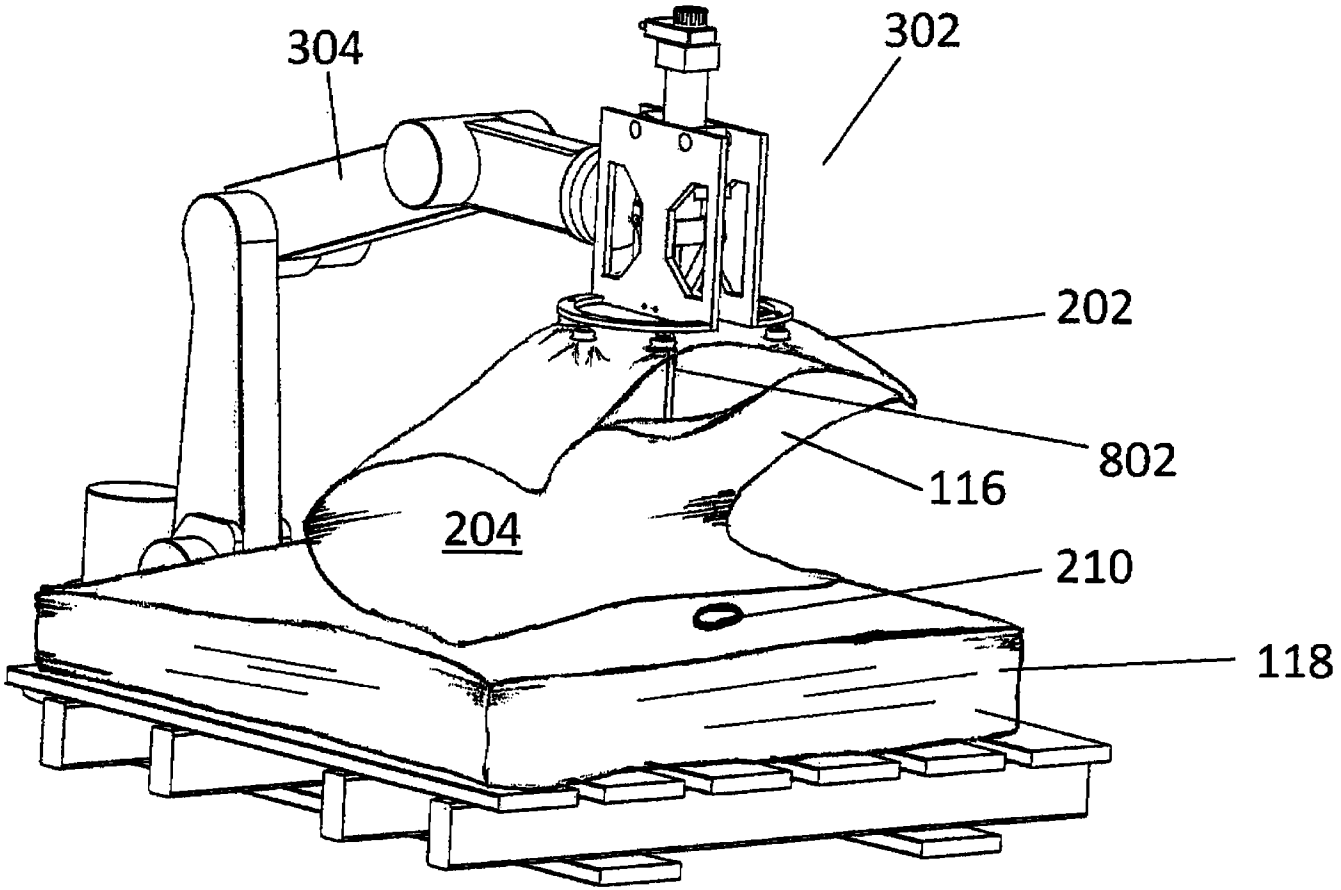

As shown in FIGS. 1 and 8A, once bag 116 has been secured to end effector 302, the end effector retreats up to its initial position, thereby lifting bag 116 from bag stack 118. As shown in FIG. 8B, in one embodiment, beak assembly 306 includes a pusher mechanism 802. For example, pusher mechanism 802 may reside within beak assembly 306 between arms 708 and 710. As end effector 302 ascends to its initial position, pusher mechanism 802 may be deployed by being extended in the opposite direction and made to contact interior surface 207*b* of second panel 204. Since end effector 302 is pulling substantially on first panel 202 of bag 116, the extension of pusher mechanism 802 against the interior surface 207*b* of second panel 204 causes pusher mechanism 802 to separate the two sides 202 and 204 and further force open bag 116. In one embodiment, pusher mechanism 802 may be a hollow rod, which can serve the dual purpose of pusher mechanism 802 and conduit 318 for providing the gas fed into beak assembly 306 as previously described.

Figure 8C:
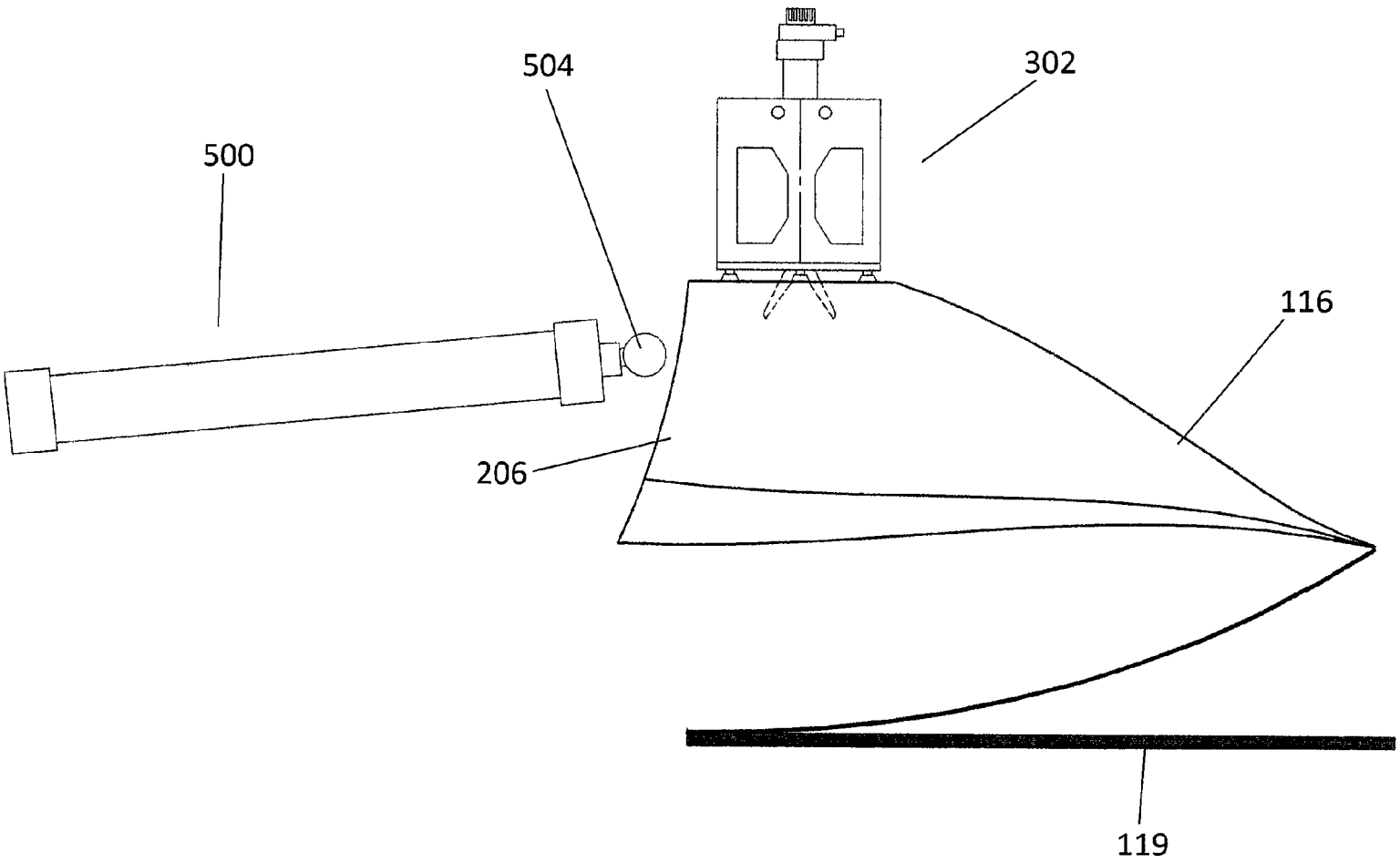
FIGS. 8C and 8D are schematic side views of an alternative embodiment incorporating a support rod.
Figure 8D:
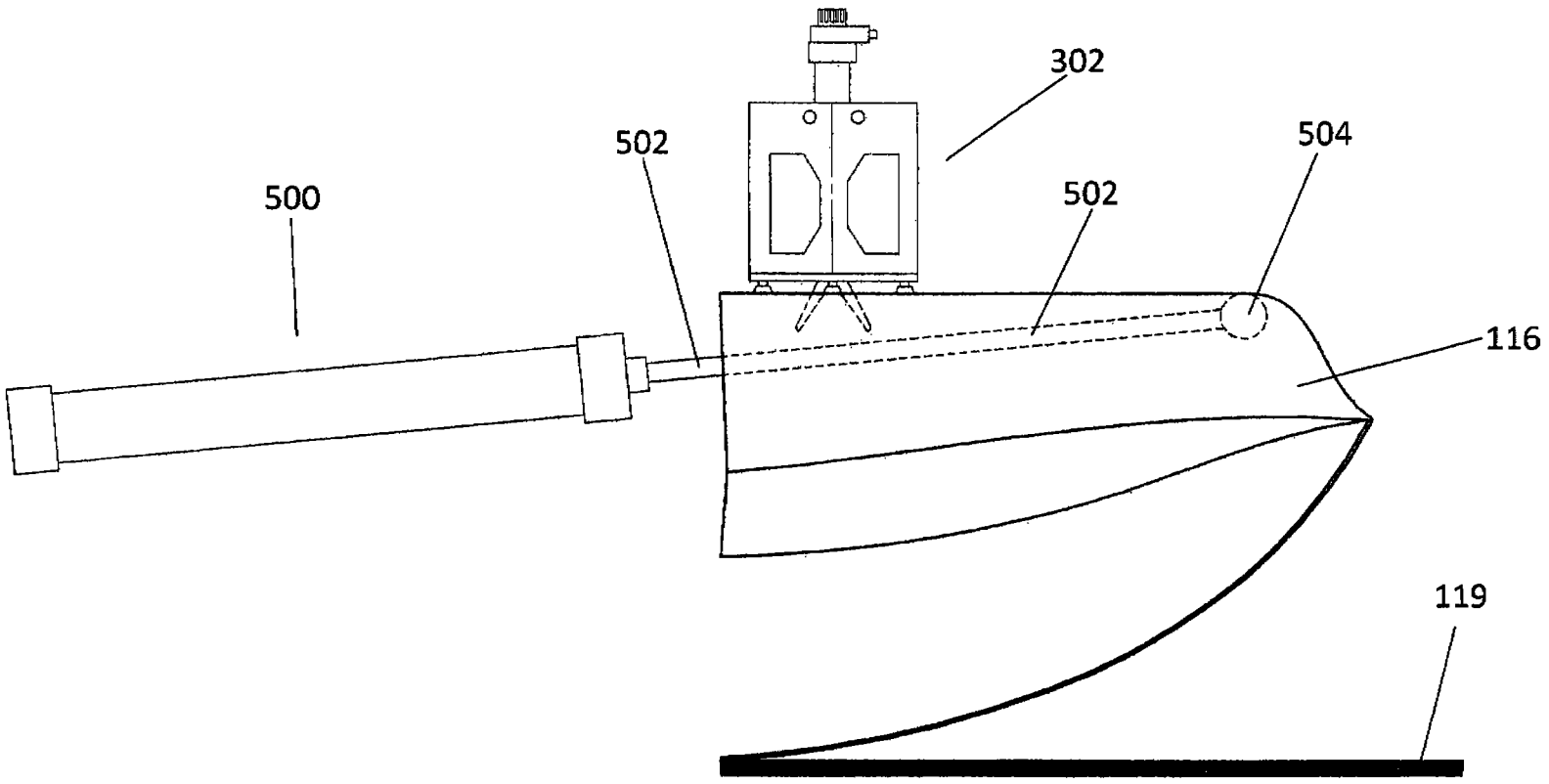

FIG. 8C is a schematic side view of the end effector 302 and bag 116 of FIG. 8B. In a further aspect, a support feature 500 is incorporated proximate the open end 206 of the bag 116. The support feature 500 may be programmed to cooperate with the end effector 302 to further support the bag. For example, with reference to FIG. 8D, the support feature may be an actuator configured for pushing a rod or shaft 502 into the opening 206 of the bag 116 to support the bag at a location spaced from the opening. To minimize catching the rod 502 against the bag 116, a smooth end tip 504 may be incorporated.

As end effector 302 ascends to its initial position with bag 116 attached, bag 116 is ready for further processing by bagging assembly 100 (FIG. 1). An exemplary operation of a bagging assembly in which bag 116 and bag retrieval assembly 110 may be incorporated is fully described in U.S. Provisional Application Ser. No. 61/033,376, which is incorporated herein by reference for all purposes.

Figure 9:
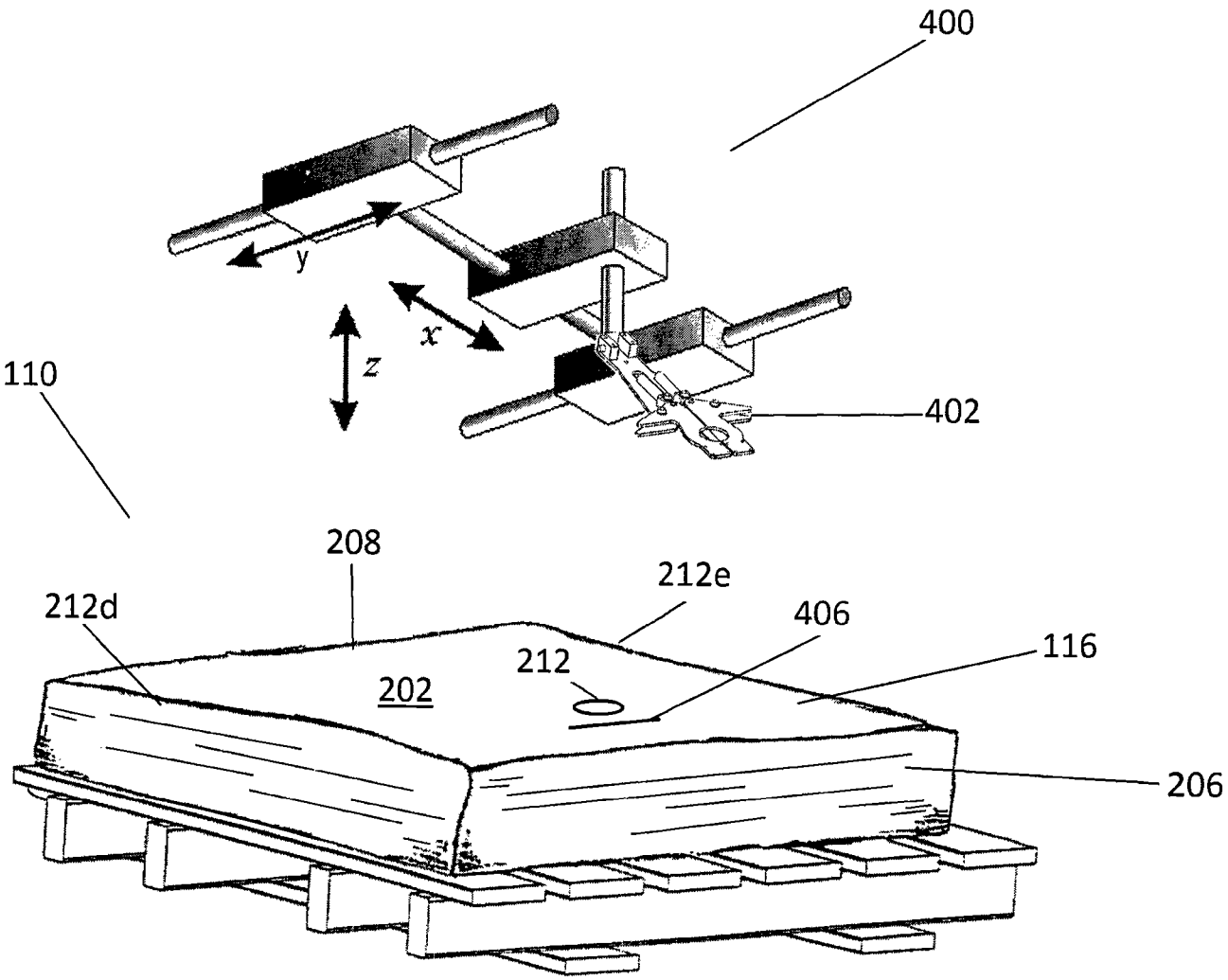
FIG. 9 is a schematic view of an alternative end effector provided in accordance with aspects of the present invention, which may be mounted on a Cartesian coordinate robot.

Referring now to FIG. 9, a schematic view of an alternative bag retrieval assembly 110 utilizing a Cartesian coordinate robot 400 is shown. As is well known in the art, the robot 400 is programmed to be movable along an X-Y plane and up and down along a Z axis to reach a specified coordinate. The robot may, in combination with a visualization system 404 (FIG. 13), be used to locate and detect a mark, a blemish, a target, or more generically an indicium 212, and movable to the specified coordinate identified by the visualization system upon detection of said mark, blemish, or indicium. In another embodiment, two or more indicia are incorporated on the surface of the bag. In one exemplary embodiment, a circle 212 is used as a mark on a first panel 202 of a bag 116 to be detected by the visualization system 404, which may be a vision sensor provided by DVT Vision System, a division of Cognex Corporation. The bag 116 further incorporates a cut section 406 for use by an end effector 402 to pick up the bag 116 for further processing by the bag positioning assembly 112, as further discussed below. In another embodiment, the indicium 212 is a reflective or darkened/colored line drawn next to the cut section. Optionally, the reflective or darkened/colored line is drawn parallel to the out section.

In one embodiment, the cut section 406 is a slit formed on only the first panel 202 of the bag 116. The cut section 406 may be about 2 to about 12 inches in length and about 1 to 10 inches from an edge of the indicium 212. Other dimensions may be incorporated without deviating from the spirit and scope of the present embodiment. However, it is understood that the cut section may represent other cut shape, such as a circle, an oval, a rectangle, etc. with a slit being more preferred. Thus, once the indica 212 is detected by the visualization system 404, the location of the slit 406 relative to the indica may be computed and the robot 400 be programmed to move to and interact with the slit to pick up the bag, as further discussed below. Like previously described bags, the current bag embodiment has an open end 206 to which the indicium 212 and the slit 406 are aligned. Most preferably, the slit and the indicium are centered relative to the two side edges 212*d* and 212*e* of the bag 116 and are positioned closer to the open end 206 than the closed end 208. In one embodiment, the slit is located about 4 to 8 inches from the open edge of the bag.

Figure 10:
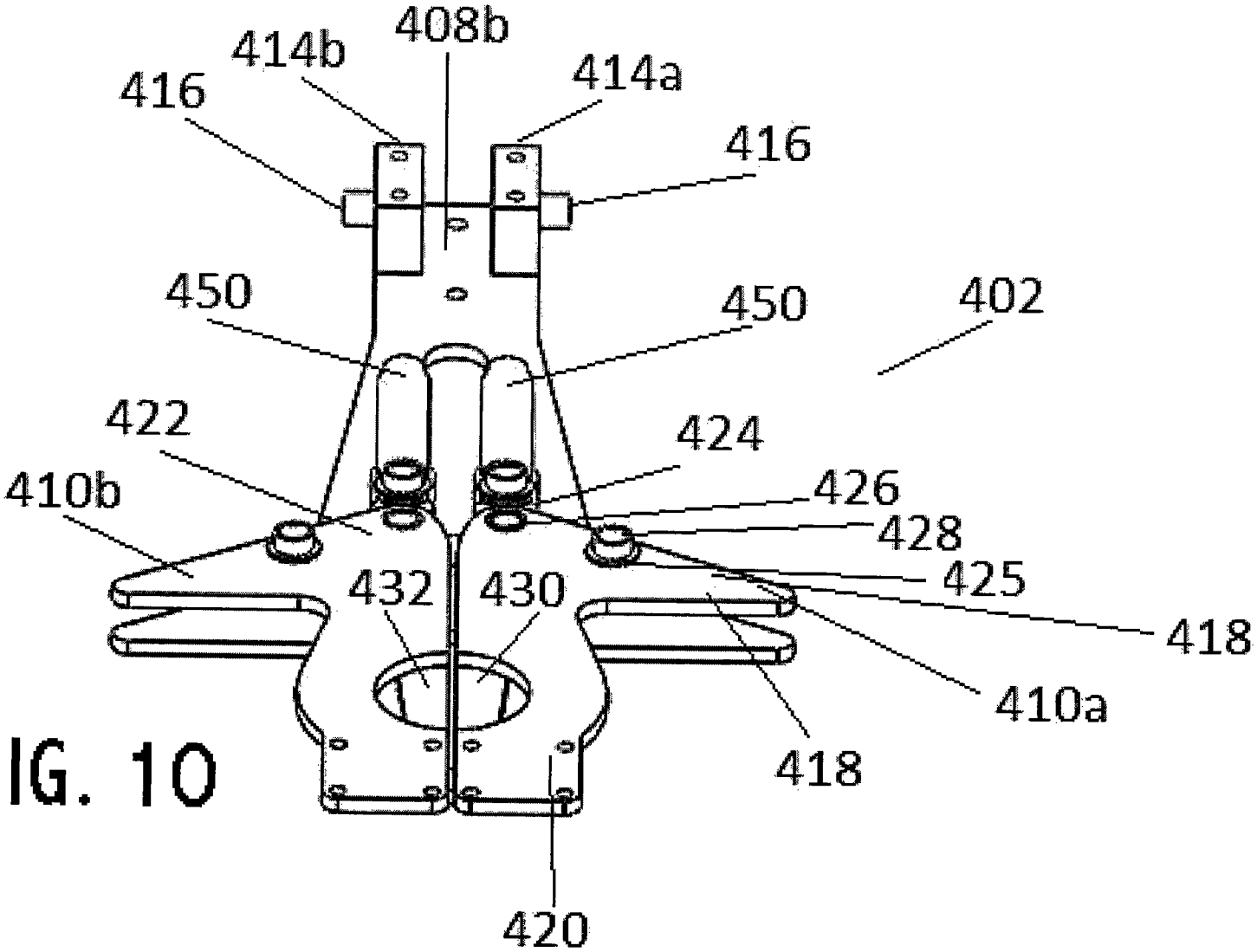
FIG. 10 is an isometric view of the end effector of FIG. 9.
Figure 11:
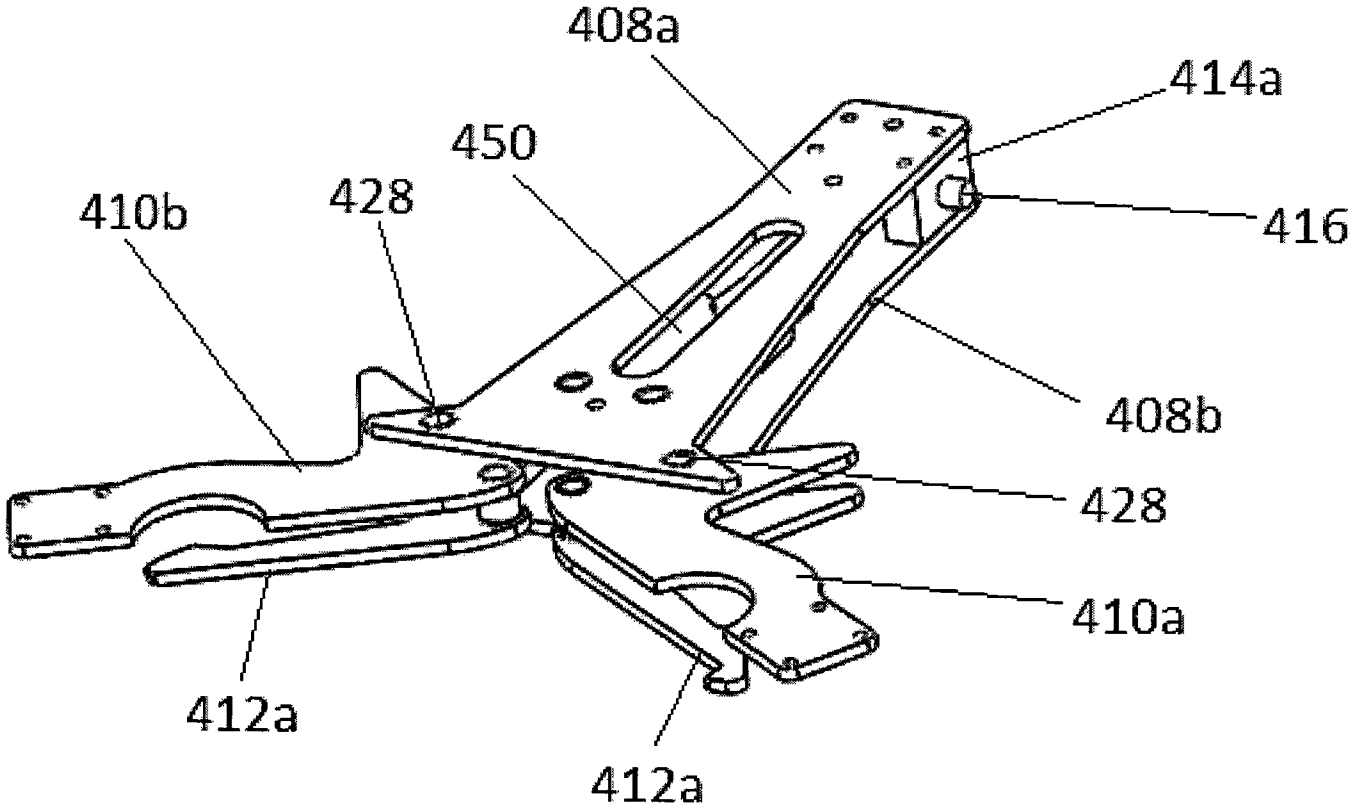
FIG. 11 is an isometric view of the end effector of FIG. 9 in an open position.

With reference now to FIGS. 10 and 11, a preferred end effector 402 for use with the Cartesian coordinate robot 400 of the present embodiment is shown. In particular, FIG. 10 is a front perspective view of the end effector 402 while FIG. 11 is an angled isometric view of the same end effector 402 with a top mounting bracket 408*a* included for a more complete view of the end effector. FIG. 10 is shown without the top mounting bracket 408*a* to show a pair of actuator cylinders 450 for manipulating an optional upper pair of spreader prongs 410*a*, 410*b* and a pair of pickup probes 412*a*, 412*b*, as further discussed below. The cylinders 450 are configured to move the probes and the prongs between an open position (FIG. 11) and a closed position (FIG. 10). Thus, the end effector 402 provided in accordance with aspects of the present invention is understood to include both upper and lower mounting brackets 408*a*. 408*b* but, depending on a particular application, may or may not include the optional upper pair of spreader prongs 410*a*, 410*b*. The probes 412*a*, 412*b* are more clearly shown in plan or top view in FIG. 12. The purpose and function of the optional upper pair of spreader prongs 410*a*, 410*b* and the pickup probes 412*a*, 412*b* are further discussed below. In another embodiment, the end effector 402 uses a single pickup probe or more than two pickup probes.

Figure 13:
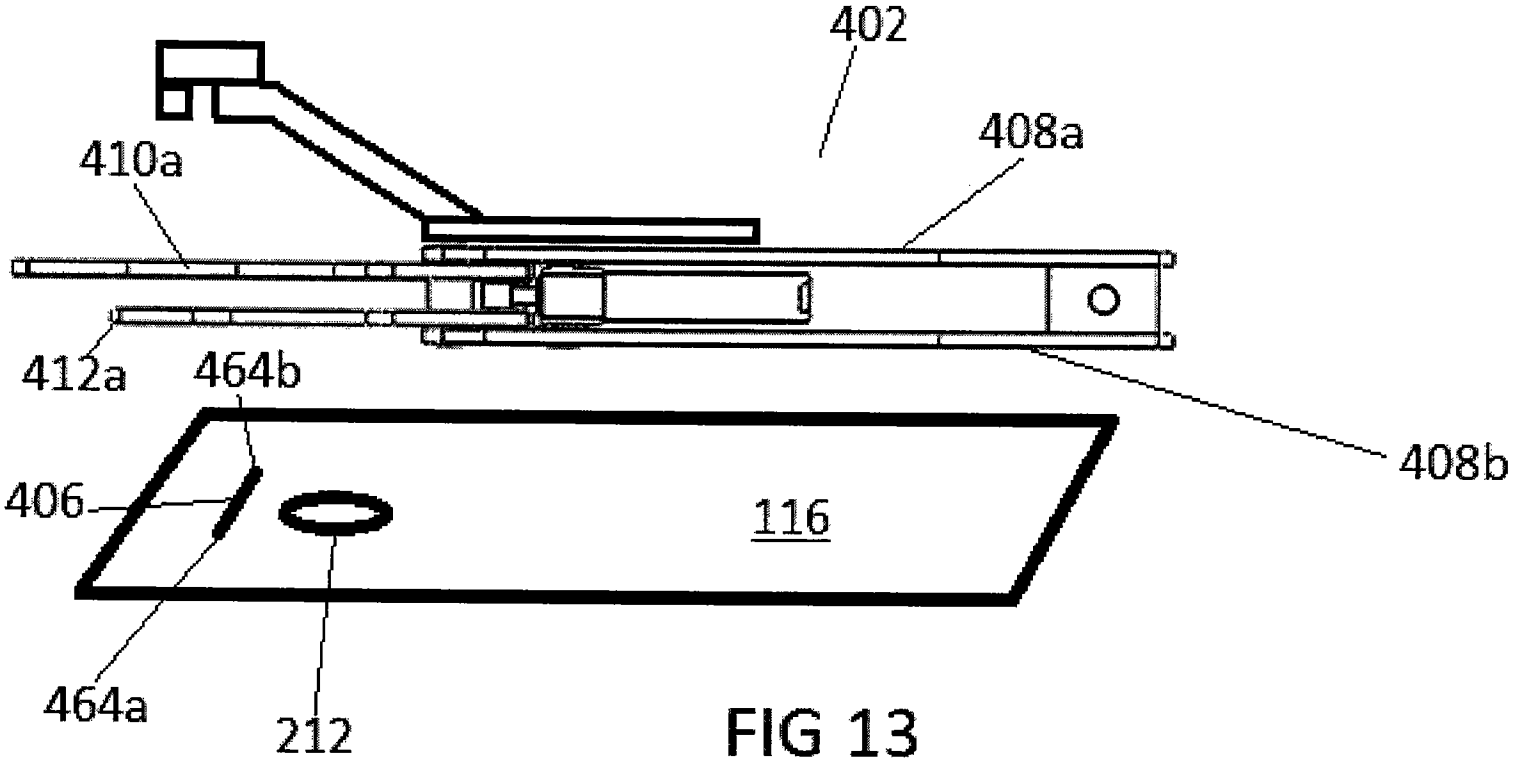
FIG. 13 is a side view of the end effector of FIG. 9 positioned above a bag for use to bag a pressed bale.
Figure 14:
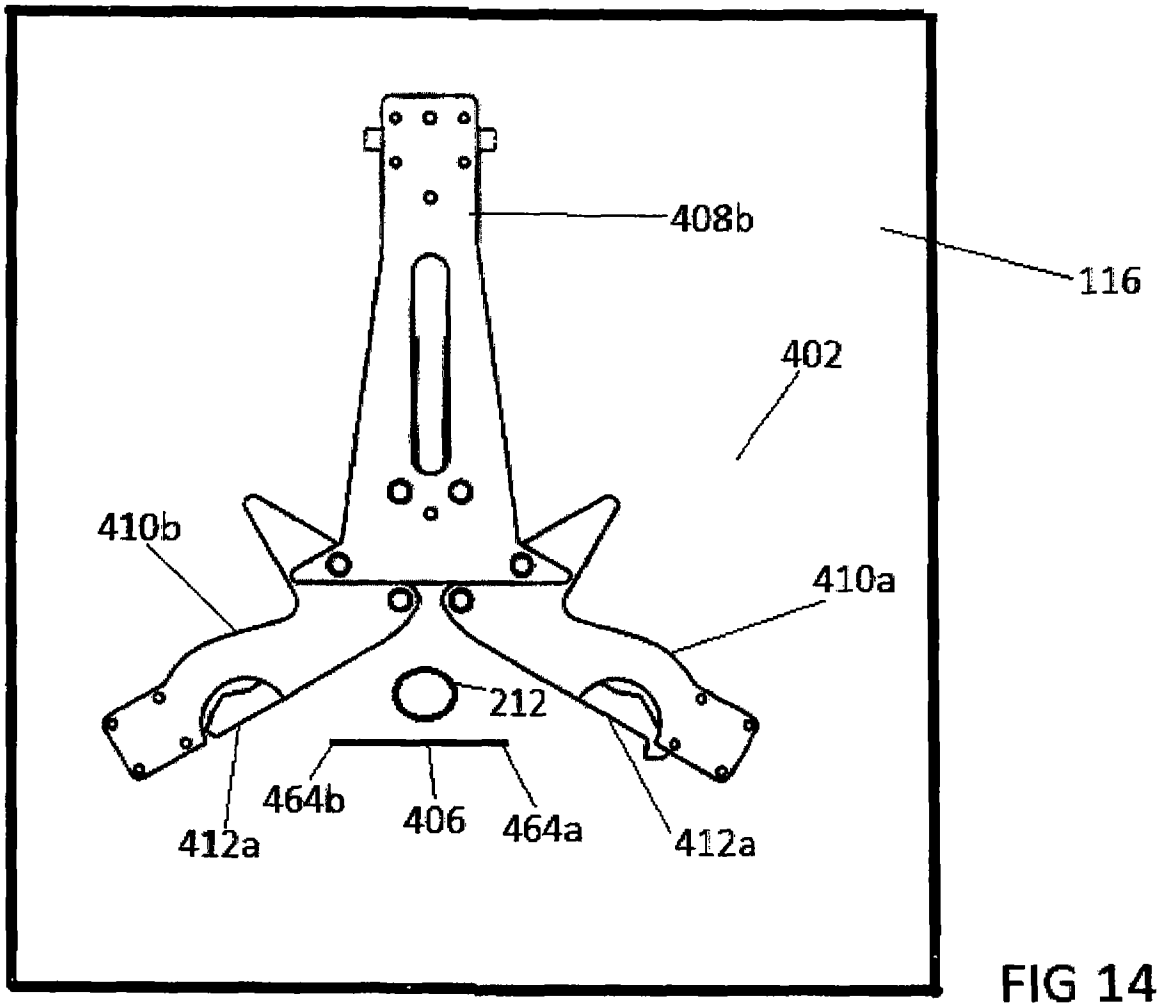
FIG. 14 is a top view of the end effector of FIG. 13 with the probes in the open position.
Figure 15:
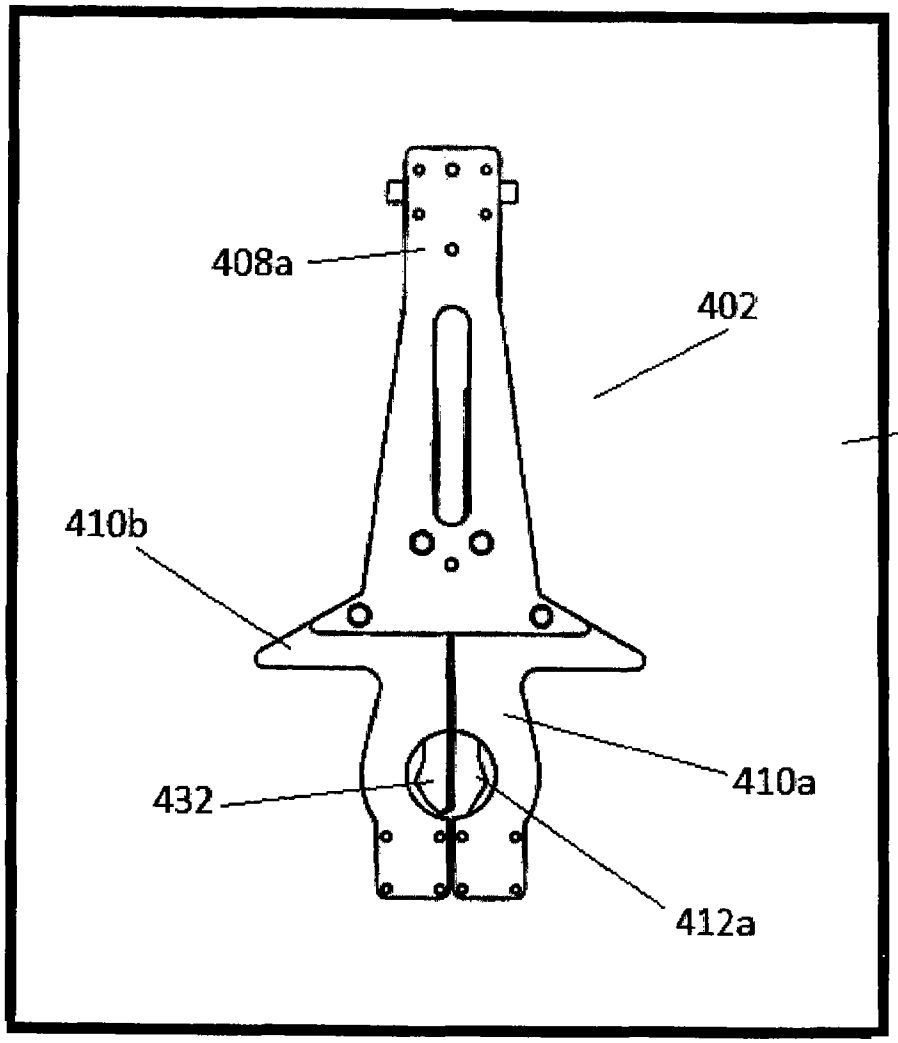
FIG. 15 is a top view of the end effector of FIG. 14 with the probes in the closed position.

Referring again to FIG. 10, in one embodiment the end effector 402 is a pickup head adapted to support a visualization system, for example, e.g., system 404 in FIG. 13. The pickup head 402 is also configured to grab a bag and pickup the bag for further processing by a bag positioning assembly 112 (FIG. 1). The pickup head 402 incorporates an upper and a lower mounting bracket 408*a*, 408*b* (lower mounting bracket shown only) having a pair of mounting blocks 414*a*, 414*b* disposed therebetween. Each mounting block 414 incorporates a dowel or pin 416 upon which the pickup head pivots. The two dowels or pins 416 are configured to mount to an end of a Cartesian coordinate robot 400 (FIG. 9) or alternatively to a coupling (not shown) that is in turn coupled to the robot. One or more air cylinders (not shown) may be used to pivot the pickup head 402 about the two pins 416 to raise or lower the probe end of the pickup head, as further discussed below with reference to FIG. 16. In an alternative embodiment, the two mounting blocks 414*a*, 414*b* are formed as a single block or more than two blocks.

The two spreader prongs 410*a*, 410*b* are generally similar in configuration with one of the prongs incorporating an overhang section for covering the tip of the other prong, as further discussed below. Thus, the discussion hereinbelow regarding the spreader prongs 410*a*, 410 are with reference to only one of the prongs with the understanding that it applies equally to the other. The spreader prong 410*a* comprises two or more wing sections, which in the current embodiment includes a proximal wing section 418 and a distal wing section 420. The two sections 418, 420 are joined together along a corner 422, which has a bore or opening 424 for receiving a rotatable pin 426. The proximal wing section 418 further incorporates a second bore or opening 425 for receiving a second pin 428. The first rotatable pin 426 is thus in pivoting communication with the corner opening 424 of the spreader prong and the corresponding opening of the pickup probe 412*a* while the second rotatable pin 428 is in pivoting communication with the outer opening 425 of the spreader prong 410*a* and the corresponding opening of the pickup probe 412*a*. The second rotable pin 428 is also in pivotable with both the upper and the lower mounting brackets 408*a*, 408*b*. Hence, when the actuator cylinder 450 is actuated, the piston rod on the cylinder 450 pushes on the inner pin 426, which causes the spreader prong 410*a* and the pickup probe 412*a* to pivot about the outer pin 428, as shown in FIG. 11. Conversely, when the actuator is de-energized and the piston rod retracts inside its cylinder, the prong 410*a* and the probe 412*a* pivot about the outer pin 428 to a closed position (FIG. 10).

The distal wing section 420 incorporates a cutout 430, which in one embodiment is a half-circle configuration that can alternatively embody other shapes, such as a half square, a half rectangle, etc. When the pickup head 402 is in a closed or probing position as shown in FIG. 10, the two cutouts 430 form a viewing window 432 for looking through and viewing the pickup probes 412*a*, 412*b*. With reference to FIG. 13, the visualization system 404 can therefore view through the viewing window 432 to determine whether the probes 412*a*, 412*b* are present or not to then generate a corresponding signal to a controller to perform other steps, as further discussed below.

Referring again to FIG. 12 in addition to FIGS. 10 and 11, the pickup probes 412*a*, 412*b* each incorporates a proximal probe section 434*a* or 434*b* and a distal probe section 436*a* or 436*b*. Like the spreader prong, each proximal probe section incorporates a corner opening 424 and an outer opening 425 for pivoting communication with corresponding pins 426, 428 (FIG. 10). In one embodiment, the probe embodies a V shape configuration and has an angular proximal edge 438 to provide added clearance when moving to an open or pickup position (FIG. 11). A catch area 440 is formed along an outer edge of the proximal and distal probe sections 434*a*, 434*b* for catching the bag 116, as further discussed below. In one embodiment, the catch area 440 includes a guide edge 442 and a retention hook 444.

Along the distal direction, the distal probe section 436 incorporates an enlarged catch portion 446, which has an apex 448 and optional frictional features such as bumps, fingers, brillo pad type fabric, etc. to facilitate gripping the bag 116 when moving to an open bag grabbing position, as further discussed below. In one particular embodiment, one of the distal probe sections incorporate an overhang 452 having an undercut area 454 to accommodate the enlarged catch section 446 of an adjacent probe. The overhang 452, which functions like a cap, covers a seam 456 that is located between the two probes 412*a*, 412*b*. Thus, when the pickup head 402 moves in the direction of the arrow 458 to penetrate and catch the slit 406 on the bag 116, the chance of just one probe entering the slit or catching an object in the seam 456 is minimized. The various components of the preferred pickup head 402 may be made from metal, such as steel or stainless steel, a composite material, or a hard plastic with steel being most preferred.

The pickup process will now be discussed with reference to FIGS. 13-18. During bagging operation using the bagging assembly 100 as provided herein, the pickup head 402 is first move to an open position (FIG. 14) by activating the two actuator cylinders 450 (FIG. 10). The visualization system 404 then takes a snap shot of the bag 116 through the opened spreader prongs 410*a*, 410*b* and pickup probes 412*a*, 412*b* to locate the position of the indica 212 relative to the pickup head 402. A controller then uses the information captured by the visualization system 402 to compute the x, y, and z coordinate to then command the robot 400 to move to the computed coordinate.

Figure 16:
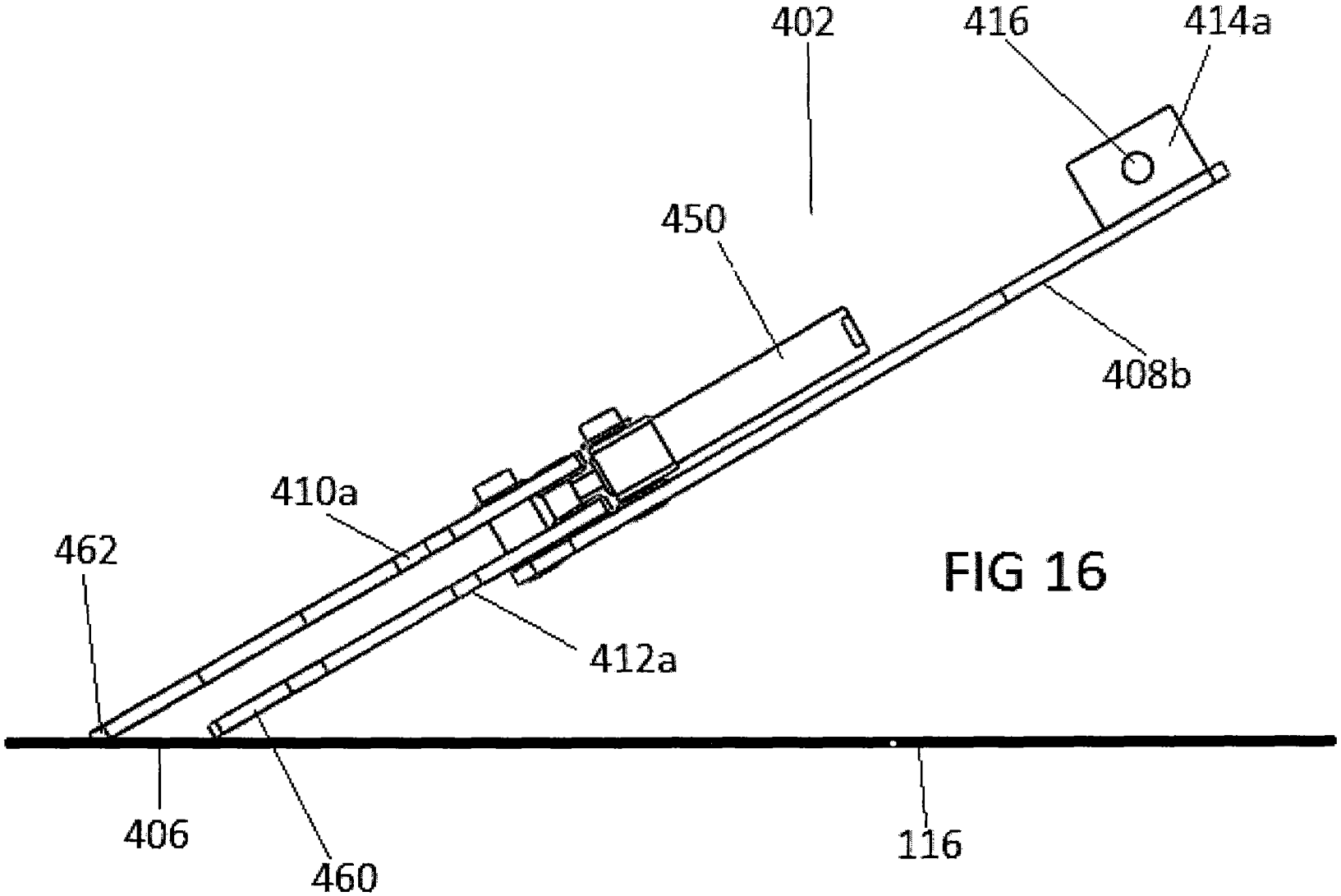
FIG. 16 is a side view of the end effector of FIG. 15 tilted against a bag for picking up the bag.
Figure 17:
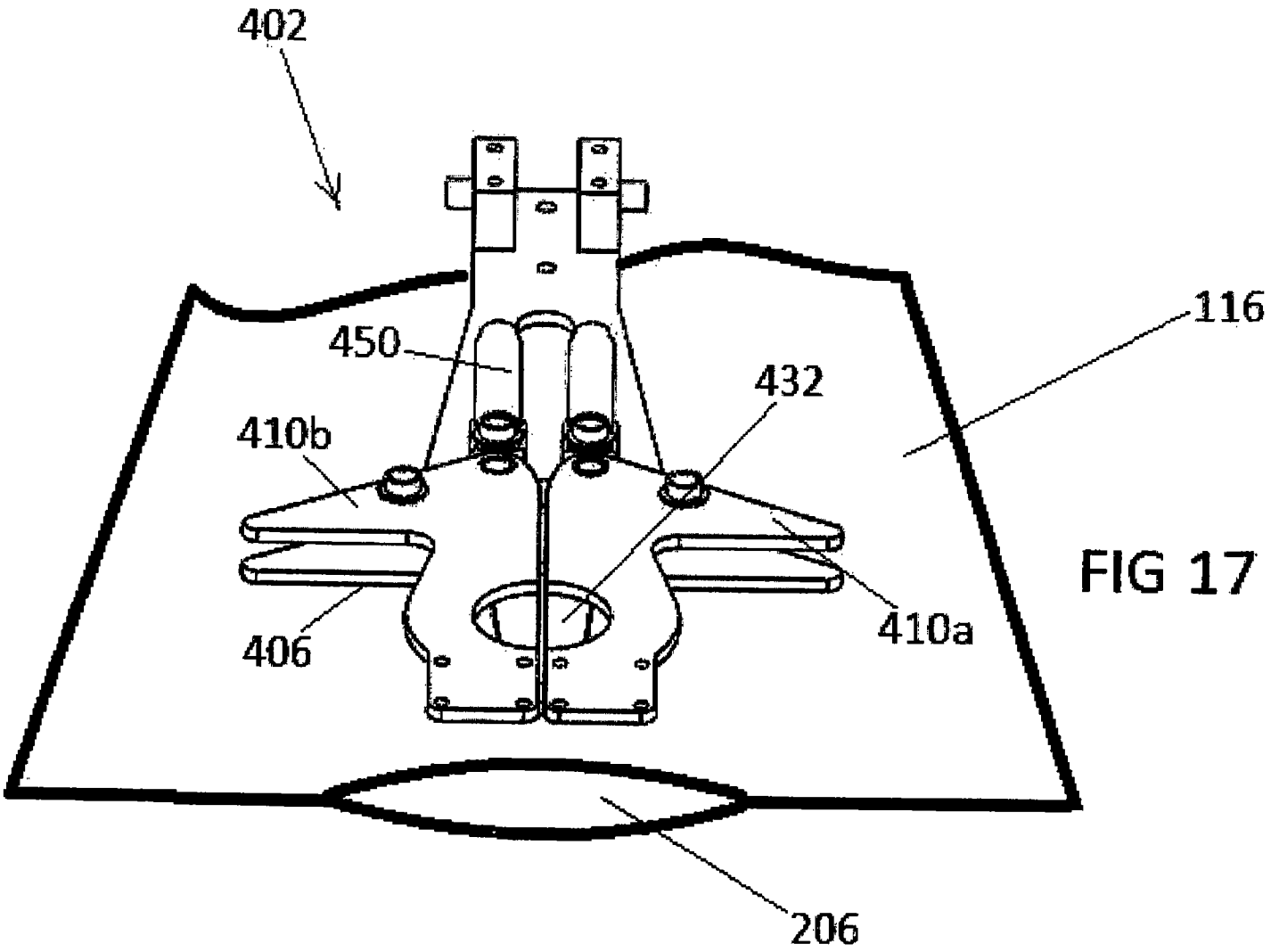
FIG. 17 is a perspective view of the end effector of FIG. 16 with the probe inserted into the cut section of the bag.

The pickup head 402 is then moved to a closed position (FIG. 15) once the desired coordinate is reached by the robot. Next, one or more actuators (not shown, such as two) are actuated to tilt the pickup head 402 so that the tip 460 of the pickup probes 412*a*, 412*b* and the tip 462 of the spreader prongs 410*a*, 410*b* straddle the slit 406 on the bag 116 and the slit is located somewhere in between the two tips (FIG. 16). Further downward pressure and distal movement of the Cartesian coordinate robot 400 causes a portion of the bag on one side of the tip 462 to be agitated and lift open by the two spreader prongs 410*a*, 410*b*. With still further distal movement of the robot 400, the tip 460 of the pickup probes 412*a*, 412*b* enters the slit and causes a portion of the bag adjacent the slit to ride up the probes. In an alternative embodiment, the pickup head 402 is adjusted so that the approach angle is less steep when initiating entry of the probe into the slit.

In one embodiment, the pickup head 402 is configured to move a predetermined axial distance once the probe is inserted into the slit. For example, the robot may be programmed to move approximately the same distance as the distance of the distal probe section measured from the tip of the overhang 452 (FIG. 12) to the horizontal sections 451 of the proximal probe sections 434*a*, 434*b*. In an alternative and more preferred embodiment, the extent of movement of the robot to position the probe into the slit is controlled by the visualization system 402. For example, with reference to FIG. 17, the robot 400 is caused to move until the probes 412*a*, 412*b* are no longer visible through the viewing window 432 by the visualization system 402. This is caused by the bag riding up the probes and covering it from view, which confirms that the probe is now safely moved into the slit. At this point, the probes 412*a*, 412*b* are covered by the bag and no longer detectable by the visualization system, which may be programmed to interpret this information as a positive insertion of the probes into the slit. Due to the angle of the pickup head, the bag 116 begins to open along its open end 206.

Figure 12:
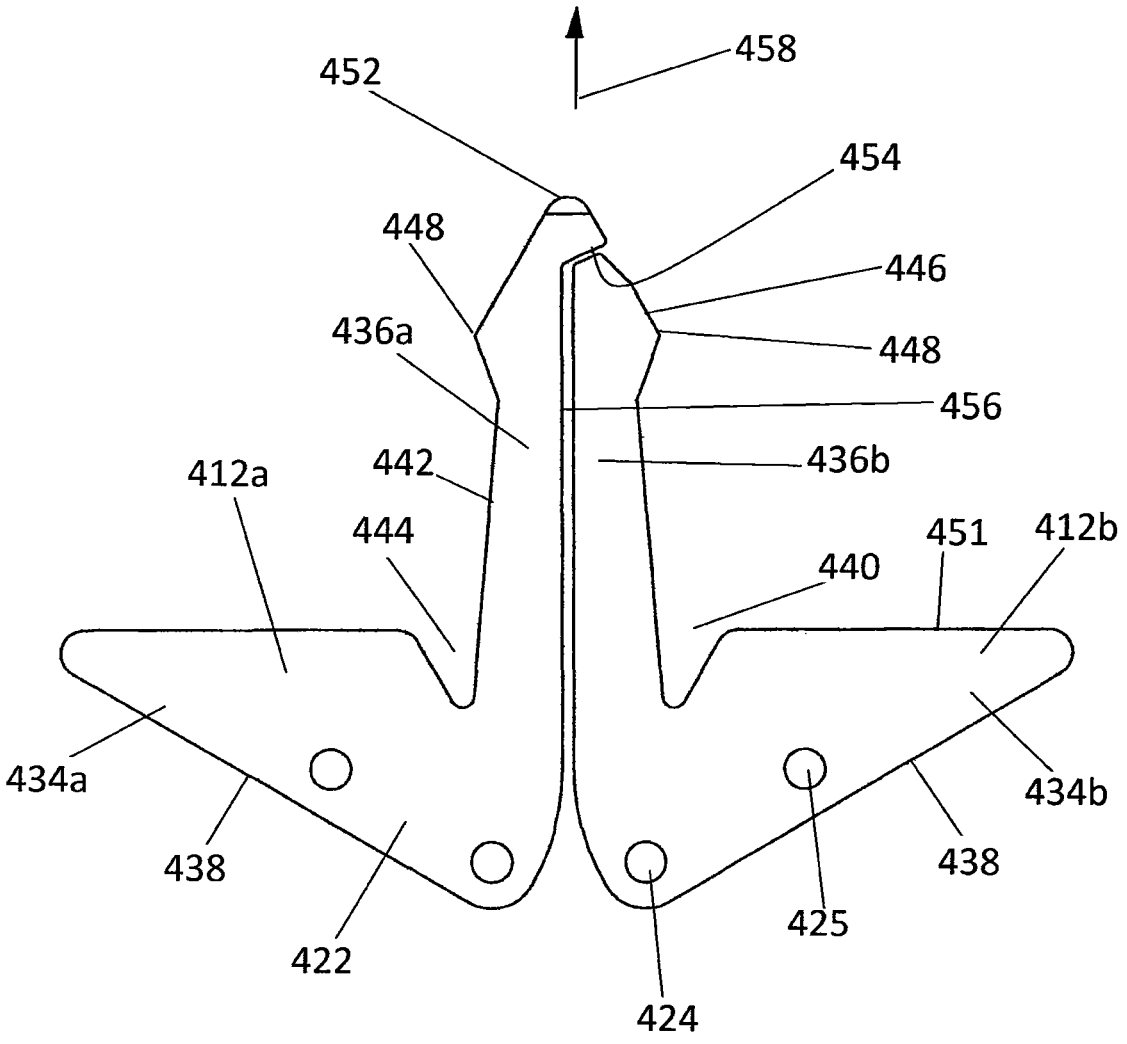
FIG. 12 is a top view of a pair of pickup probes provided in accordance with aspects of the present invention.
Figure 18:
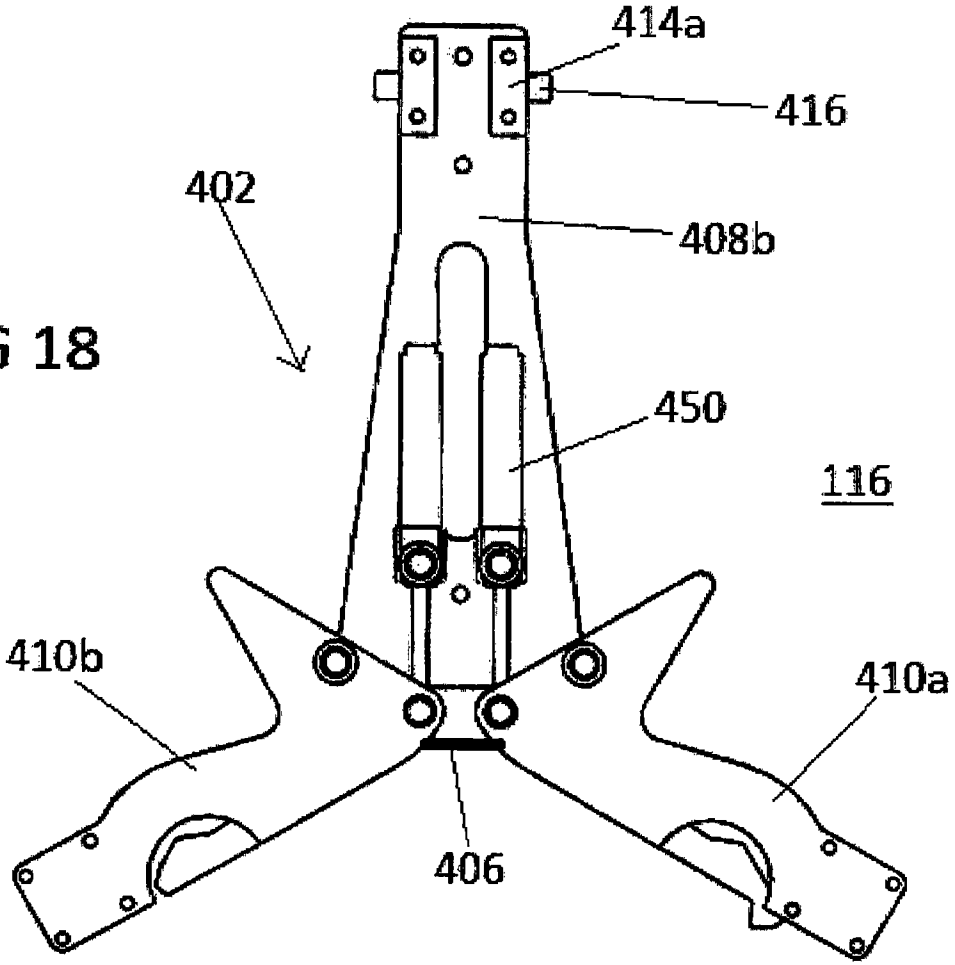
FIG. 18 is a top view of the end effector of FIG. 17 with the probe inserted into the cut section of the bag and opened to engage the bag.

The pickup head 402 is now actuated to move to an open position as shown in FIG. 18. With reference also to FIG. 12, during this process, the two pickup probes 410*a*, 410*b* pivot about the outer pins at their respective outer opening 425 until stopped by the two actuator cylinders 450 (FIG. 10). At this point, the two edges 464*a*, 464*b* of the slit are captured by the retention hooks 494 on the two pickup probes 410*a*, 410*b* and the bag is ready to be raised and moved away from the stack of bags.

When the bag 116 is raised and because it is only held on one side, the open end 206 of the bag opens further due to gravity. A blast of air from an appropriately placed nozzle could, if needed, assist in opening a bag made from a material that may not want to naturally separate, such as due to static elasticity or natural adhesion forces. The open end can now be entered by the positioning arms on the bag positioning assembly 112 (FIG. 1) to then place the bag around a chute, as discussed in application Ser. No. 61/033, 376, which was previously incorporated by reference.

Figure 19:
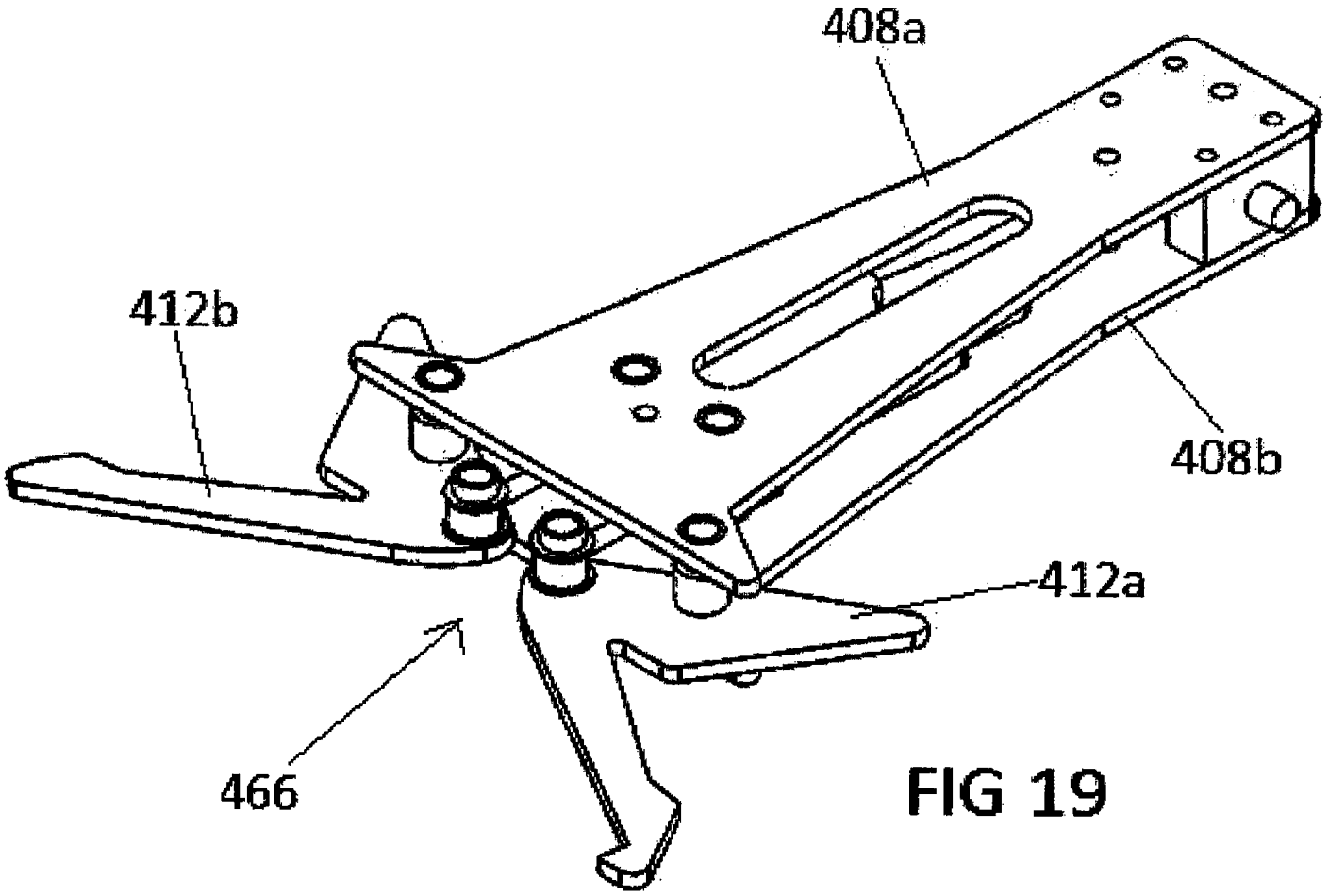
FIG. 19 is a perspective view of an alternative end effector provided in accordance with aspects of the present invention.
Figure 19A:
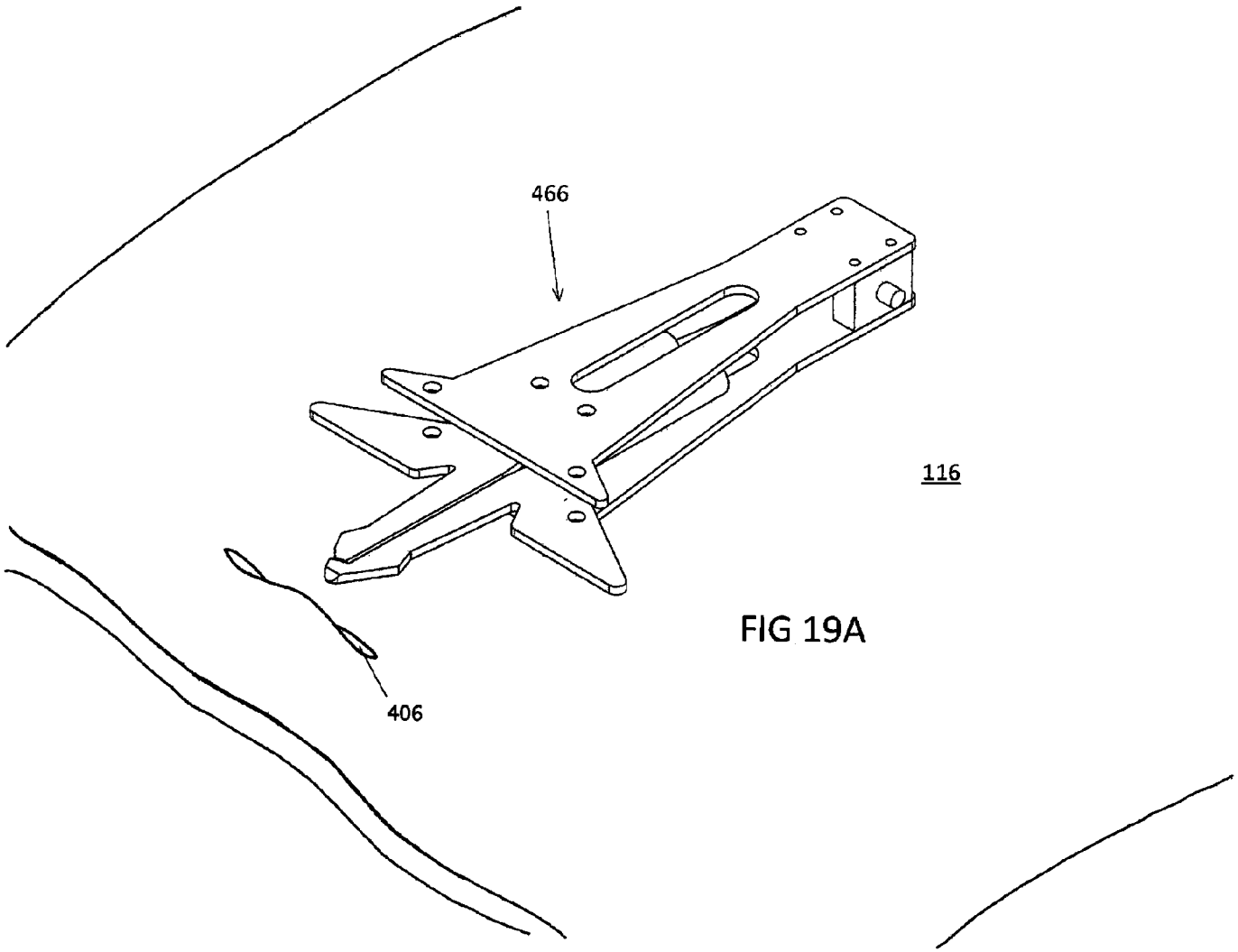
FIGS. 19A-19C are schematic views of the end effector of FIG. 19 in service.
Figure 19B:
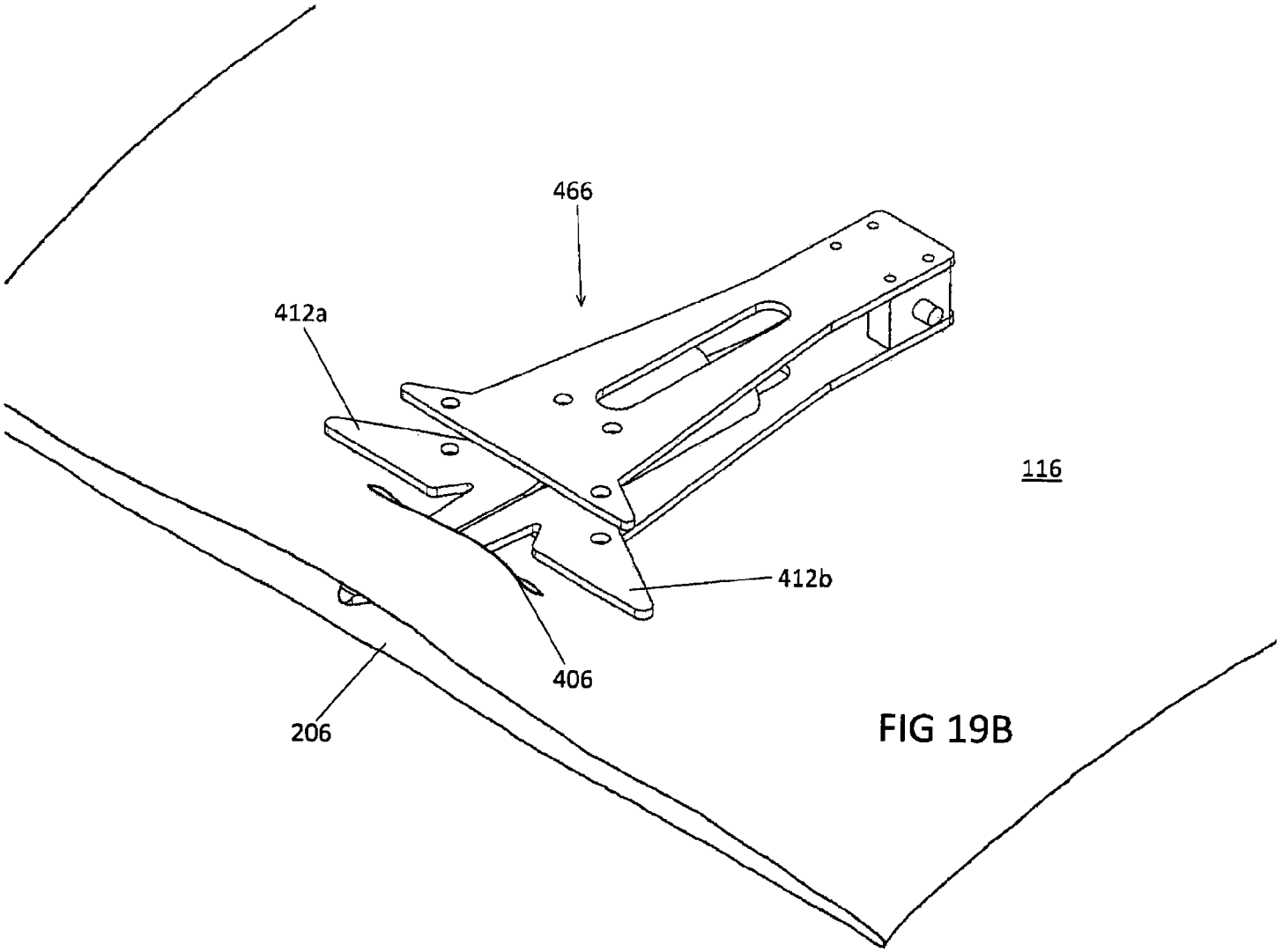
Figure 19C:
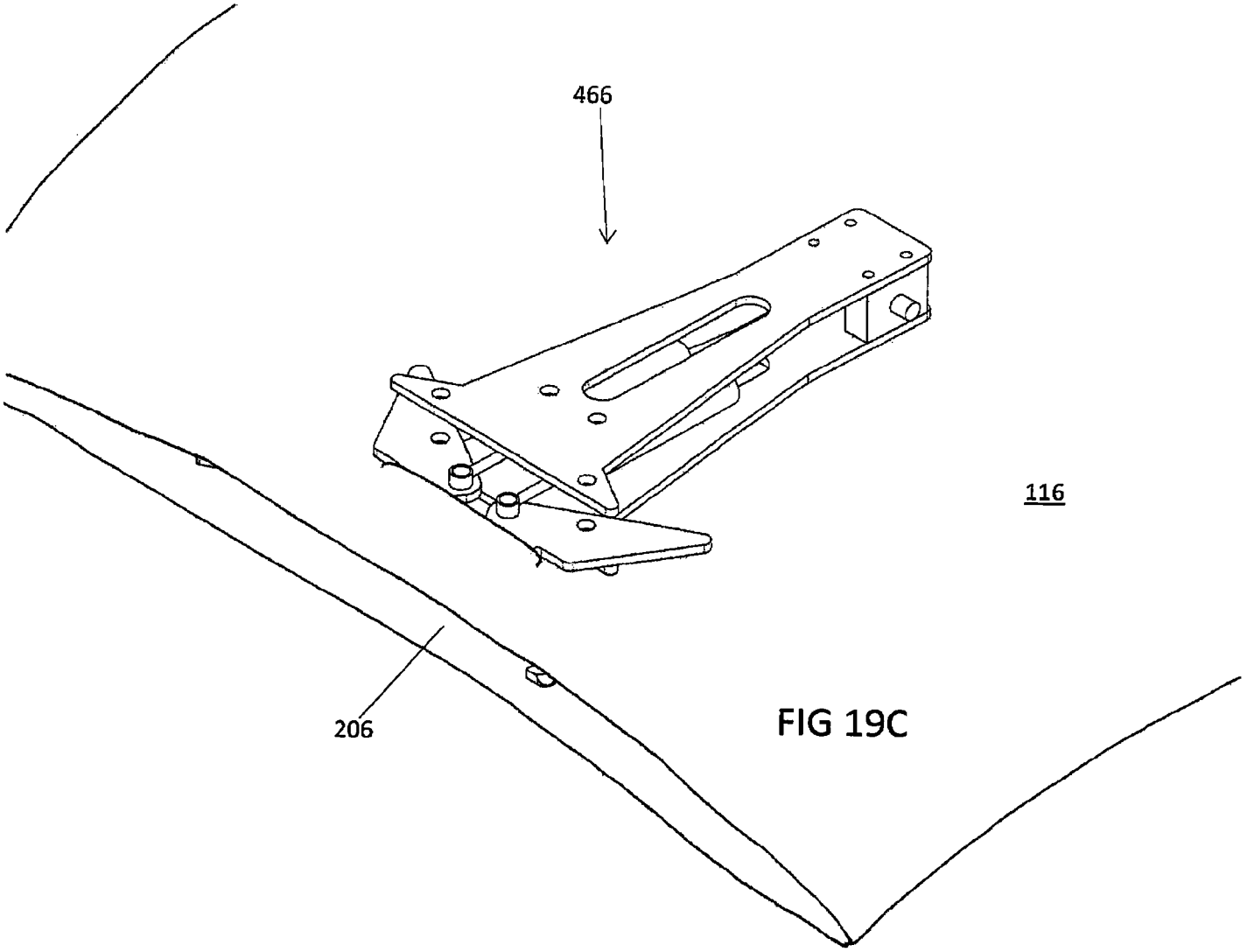

FIG. 19 is a perspective view of a pickup head 466 provided in accordance with aspects of the present invention. The pickup head 466 is nearly identical to the pickup head 402 disclosed with reference to FIGS. 10-18 with one exception, the spreader prongs 410*a*, 410*b* for facilitating the lifting of the lip around the slit 406 of a bag 116 have been eliminated. Thus, in using the pickup head 466 of the present embodiment, the Cartesian coordinate robot can simply make a series of probing motion to insert the probes 412*a*, 412*b* into the slit without having to lift the lip of the slit 406. FIGS. 19A-19C are schematic views of the alternative pickup head 466 moving into the slit 406. In one example, a sensor (not shown) is incorporated to indicate successful entry by the pickup head 466 into the slit so that the next operation sequence may be initiated.

In still yet another embodiment, an end effector comprising a single probe (not shown) is used to engage a cut section of a bag to separate the bag from a roll of bags or a stack of bags. The single probe may have a barb end, a frictional tip, and/or a hook end so that once the probe enters the cut section, the probe engages the bag and may be lifted without a spreader device. Yet in another embodiment, an end effector comprising a plurality of spaced apart probes, similar to a fork, may be used to pick up a bag.

Although embodiments of the bag and bag retrieval assembly have been specifically described and illustrated, many modifications, combinations, and variations of the embodiments will be apparent to those skilled in the art. For example, the dimensions of the bag and the positioning of the robotic device within the housing may be modified to achieve their intended purpose. Furthermore, although specific features and aspects may be discussed for a particular embodiment, they are understood to be useable and may be incorporated in other embodiments provided to functions are compatible. For example, where the end effector of FIG. 3 is described as capable of moving along multiple axes or alternative is fixed for use with a movable stack of bags, the same concept may be used for end effectors of FIGS. 9 and 19. Accordingly, it is to be understood that the bag and bag retrieval assembly constructed according to principles of this invention may be embodied other than as specifically described herein. The invention is also defined in the following claims.

What is claimed is:

1. A bag for bagging a pressed bale comprising:

a body portion made from a material comprising plastic, nylon, burlap, cotton, or combinations thereof having a bottom end, opposed first and second panels each comprising an exterior surface and an interior surface extending from the bottom end and opposed first and second side panels extending from the bottom end and connecting the first and second panels; the bottom end, the first and second panels, and the first and second side panels defining a receptacle space and defining an open end located opposite the bottom end, the material selected and the open end sized and shaped to receive a pressed bale of fibrous material;

a cut portion formed through the first panel and presenting an opening on the exterior surface and the interior surface of the first panel for receiving a probe to lift the body portion, the cut portion positioned at a location on the first panel nearer the open end of the bag than the bottom end of the bag; and wherein when the open end is closed, the interior surface of the first panel around the opening of the cut portion is in contact with and covered by the interior surface of the second panel and the cut portion is flushed with the exterior surface of the first panel.

2. The bag of claim 1, further comprising a mark positioned proximate the cut portion, the mark providing an indication of the location of the cut portion.

3. The bag of claim 1, wherein the cut portion comprises a slit having a length that is longer than a width to receive a probe.

4. The bag of claim 1, wherein the cut portion is detectable using a detection system, the detection system comprising a camera system, an OCR system, or a machine vision system.

5. The bag of claim 2, wherein the mark comprises a word or a logo and wherein the cut portion is incorporated into the word or the logo.

6. The bag of claim 5, wherein the cut portion is deformable when picked up by an automatic retrieval system to pick up the bag for use with a chute.

7. The bag of claim 6, wherein the cut portion is without a foldable flap.

8. The bag of claim 1, wherein the cut portion is a single linear cut.

9. The bag of claim 1, wherein the first and second panels and opposed first and second side panels are made from plastic and in a roll format.

10. The bag of claim 9, wherein the plastic is polypropylene, polyethylene, or polyester.

11. The bag of claim 1, further comprising a second cut portion spaced away from the cut portion.

12. The bag of claim 1, wherein the opening of the cut portion is at least 2 inches in length and is located up to about 8 inches from a perimeter defining the open end.

13. The bag of claim 12, wherein when the first panel and the second panel are flattened such that at least a portion of the interior surface of the first panel contacts a portion of the interior surface of the second panel, a section of the second panel without any cut portion lies flat against the cut portion of the first panel and the interior surface of the second panel touches the interior surface around the cut portion.

14. The bag of claim 1, further comprising a pressed bale having at least two straps positioned in the receptacle space.

15. The bag of claim 1, further comprising a probe located in the cut portion of the first panel.

16. The bag of claim 1, further comprising a sensor of a bagging assembly to sense the cut section or an edge of the bag.

17. The bag of claim 1, wherein the cut portion has a length of between two inches to eleven inches in length.

18. The bag of claim 1, wherein the first and second side panels are each folded when the open end is closed.

19. A bag for bagging a pressed bale comprising:

a body portion made from a material comprising plastic, nylon, burlap, cotton, or combinations thereof, said body portion having a bottom end, opposed first and second panels each comprising an exterior surface and an interior surface extending from the bottom end, and opposed first and second side panels extending from the bottom end and connecting the first and second panels; the bottom end, the first and second panels and the first and second side panels defining a receptacle space and defining an open end located opposite the bottom end for receiving a pressed bale of fibrous material;

a cut portion formed through the first panel having an elongated slit with a length of between about 2 inches to about 12 inches and at a location on the first panel nearer the open end of the bag than the bottom end of the bag, the slit being sized to receive a probe for raising the first panel to open the open end of the body portion; and wherein when the open end is closed, the interior surface of the first panel is contacted and covered by the interior surface of the second panel and the cut portion is flushed with the exterior surface.

20. The assembly of claim 19, wherein the length of the slit is about 3 inches to about 6 inches.

21. The assembly of claim 20, wherein the slit is located up to about 8 inches from an edge that defines the open end of the body portion for receiving a probe to open the open end.

22. The assembly of claim 19, wherein the bag is positioned on a stack of bags and wherein each bag in the stack of bags comprises an elongated slit with a length of between about 2 inches to about 12 inches.

23. The assembly of claim 19, wherein the bag is in a roll format with a plurality of other bags, and wherein each of the plurality of other bags comprises an elongated slit with a length of between about 2 inches to about 12 inches.

24. The assembly of claim 23, wherein the bag and the plurality of other bags are made from polypropylene, polyethylene, or polyester.

25. The assembly of claim 19, wherein the slit is a single straight cut without a folded flap.

26. The assembly of claim 19, wherein the interior surface around the slit is contacted by the interior surface of the second panel.

27. A bag for bagging a pressed bale comprising:

a body portion made from a material comprising plastic, nylon, burlap, cotton, or combinations thereof, said body portion having a bottom end and joined first and second panels each comprising an exterior surface and an interior surface extending from the bottom end to define a receptacle space having an open end having an open end edge located opposite the bottom end for receiving a pressed bale of fibrous material;

a cut portion forming a slit through the first panel; the slit having two generally parallel edges and a length of between about 2 inches to about 12 inches and the two generally parallel edges of the slit being generally parallel to the open end edge of the open end of the body; the slit being sized to receive a probe for raising the first panel to open the open end of the body portion; and wherein when the open end is closed, the interior surface of the first panel is contacted and covered by the interior surface of the second panel and the cut portion is flushed with the exterior surface.

28. The bag of claim 27, wherein the bag is positioned on a stack of bags and wherein each bag in the stack of bags comprises an elongated slit with a length of between about 2 inches to about 12 inches.

29. The bag of claim 27, wherein the bag is in a roll format with a plurality of other bags, and wherein each of the plurality of other bags comprises an elongated slit with a length of between about 2 inches to about 12 inches.

30. The assembly of claim 29, wherein the bag and the plurality of other bags are made from polypropylene, polyethylene, or polyester.

31. The bag of claim 27, wherein the interior surface around the slit is contacted by the interior surface of the second panel.

32. The bag of claim 27, wherein the slit provides an indicator for a pick-up device and an opening for use by the pick-up device to pick up the bag.

33. The bag of claim 27, wherein the open end is sized and shaped to fit over a chute and the chute is sized and shaped to receive a pressed bale.

* * * * *